US011318333B1

(12) United States Patent
Ellerbrake

(10) Patent No.: US 11,318,333 B1
(45) Date of Patent: May 3, 2022

(54) RESPIRATORY PROTECTION SYSTEM

(71) Applicant: Christopher T. Ellerbrake, Lebanon, IL (US)

(72) Inventor: Christopher T. Ellerbrake, Lebanon, IL (US)

( * ) Notice: Subject to any disclaimer, the term of this patent is extended or adjusted under 35 U.S.C. 154(b) by 0 days.

(21) Appl. No.: 17/233,444

(22) Filed: Apr. 17, 2021

(51) Int. Cl.

| | |
|---|---|
| ***A62B 9/04*** | (2006.01) |
| ***A62B 7/10*** | (2006.01) |
| ***A62B 23/02*** | (2006.01) |
| ***A41D 13/11*** | (2006.01) |
| ***A62B 18/02*** | (2006.01) |
| ***A62B 18/08*** | (2006.01) |
| ***A62B 18/00*** | (2006.01) |
| ***A62B 18/04*** | (2006.01) |
| ***A62B 23/00*** | (2006.01) |

(52) U.S. Cl.
CPC ..... *A62B 9/04* (2013.01); *A41D 13/1184* (2013.01); *A62B 7/10* (2013.01); *A62B 18/003* (2013.01); *A62B 18/006* (2013.01); *A62B 18/02* (2013.01); *A62B 18/025* (2013.01); *A62B 18/04* (2013.01); *A62B 18/084* (2013.01); *A62B 23/00* (2013.01); *A62B 23/02* (2013.01); *A41D 13/1161* (2013.01)

(58) Field of Classification Search
CPC ..... A62B 17/006; A62B 18/04; A62B 18/006; A62B 18/00; A62B 23/00; A62B 7/00; A62B 7/10; A62B 18/003; A62B 23/02; A62B 9/04; A62B 18/084; A62B 18/02; A62B 18/025; A41D 13/1184; A41D 13/1161; A61M 16/0688; A61M 16/0683; A61M 16/0694; B63C 2011/128; A61F 9/027; A61F 9/045
See application file for complete search history.

(56) References Cited

U.S. PATENT DOCUMENTS 2,032,101 A 2/1936 Sullivan
2,099,464 A * 11/1937 Bruner ..... A61F 9/028 2/436

(Continued)

FOREIGN PATENT DOCUMENTS

DE 202020105652 U1 * 10/2020 ..... A62B 18/084

OTHER PUBLICATIONS

English translation for DE202020105652, espacenet.com, translated on Jun. 30, 2021.*

*Primary Examiner* — Tu A Vo
(74) *Attorney, Agent, or Firm* — Campbell IP; Dutro E. Campbell, II

(57) ABSTRACT

The invention relates to a powered air-purifying respirator (PAPR) system with a transparent multi-use face shield, a foam frame attached to the interior face of the face shield, a flexible hose secured within a hole bore through the foam frame, a portable air filtering enclosure and a pump contained therein that introduces filtered air into the system through the flexible hose, and a non-woven HEPA cloth carry bag that also functions as an air filter. The face shield features a fastener system that includes flexible straps made from a transparent, flexible, non-stick, and self-adhesive releasable tape. The invention provides the user eye protection and respiratory protection from direct fluid spray, flying debris, unclean air, unhealthy airborne contaminants, including SARS-CoV-2 and other harmful viruses or pathogens.

24 Claims, 20 Drawing Sheets

(56) References Cited

U.S. PATENT DOCUMENTS 2,333,054 A * 10/1943 Sullivan ..... A62B 18/003 128/200.27
2,577,607 A * 12/1951 Conley ..... A61F 9/068 128/201.25
2,965,902 A * 12/1960 Louch ..... A61F 9/026 2/9
3,137,295 A * 6/1964 Stansfield ..... A61F 9/06 128/206.24
3,467,965 A * 9/1969 Murphy ..... A61F 9/068 2/8.6
3,649,964 A * 3/1972 Schoelz ..... A61F 9/068 128/205.25
3,822,698 A * 7/1974 Guy ..... A62B 18/045 128/201.25
4,136,688 A 1/1979 Gorman
4,676,236 A * 6/1987 Piorkowski ..... A62B 18/04 128/200.28
4,752,974 A 6/1988 Haino
5,054,479 A * 10/1991 Yelland ..... A61F 9/02 128/201.25
5,410,757 A * 5/1995 Vienamo ..... A61F 9/028 128/201.23
5,533,500 A * 7/1996 Her-Mou ..... A42B 3/288 128/201.24
5,577,495 A 11/1996 Murphy
5,816,243 A * 10/1998 Georgiou ..... A62B 17/04 128/205.24
5,878,742 A * 3/1999 Figueredo ..... A62B 18/003 128/201.24
6,014,971 A * 1/2000 Danisch ..... A62B 18/045 128/201.25
7,597,101 B2 10/2009 Burnett et al.
8,453,262 B2 6/2013 Green
9,038,199 B2 5/2015 Becker et al.
9,271,872 B2 3/2016 Becker et al.
9,861,142 B1 * 1/2018 Rebecchi ..... F04D 25/0673
10,441,828 B2 10/2019 Curran et al.
10,806,235 B1 * 10/2020 Bernstein ..... A41D 13/1184
10,901,167 B1 * 1/2021 Courter, Jr. ..... G02B 7/021
10,945,469 B1 * 3/2021 Rosenberg ..... A41D 13/1161
10,945,470 B1 * 3/2021 Maroofian ..... A41D 13/1107
10,952,812 B1 * 3/2021 Saadat ..... A62B 18/08
11,006,681 B1 * 5/2021 Campos ..... A41D 13/1184
11,065,479 B1 * 7/2021 Rafalovich ..... A62B 7/10
11,071,881 B1 * 7/2021 Cullen ..... A62B 9/02
11,206,881 B2 * 12/2021 Sprouse ..... A41D 13/1184
11,206,882 B1 * 12/2021 Bornstein ..... A41D 13/1184
11,219,254 B2 * 1/2022 Memita ..... A61F 9/045
2004/0089302 A1 * 5/2004 Foss ..... A62B 17/04 128/204.18
2007/0163588 A1 7/2007 Hebrank et al.
2009/0078259 A1 * 3/2009 Kooij ..... F16L 3/13 128/205.25
2010/0108067 A1 * 5/2010 Walker ..... A62B 18/10 128/205.24
2010/0263673 A1 * 10/2010 Kielow ..... A62B 18/025 128/206.15
2013/0139288 A1 * 6/2013 Gisquiere ..... A42B 3/185 2/10
2015/0250237 A1 * 9/2015 Shoham ..... B29C 51/422 2/9
2017/0028157 A1 * 2/2017 Nitta ..... A61M 16/0066
2017/0281889 A1 * 10/2017 Voncken ..... A61M 16/0622
2018/0242679 A1 8/2018 Johnstone et al.
2018/0311515 A1 * 11/2018 Wilson ..... A62B 18/08
2019/0166928 A1 * 6/2019 Miwa ..... A41D 13/005
2020/0245700 A1 * 8/2020 Jordanov ..... A41D 13/1184
2020/0268995 A1 * 8/2020 Shin ..... A61M 16/06
2020/0275724 A1 * 9/2020 Jefferis ..... A42B 3/0406
2020/0324150 A1 * 10/2020 Nelson ..... A61M 16/20
2020/0376305 A1 * 12/2020 Lang ..... A62B 18/025
2021/0001157 A1 * 1/2021 Rashaud ..... A62B 17/006
2021/0275841 A1 * 9/2021 Conrad ..... A41D 13/1184
2021/0282477 A1 * 9/2021 Man ..... A41D 13/1184
2021/0289851 A1 * 9/2021 Hall ..... B01D 39/1623
2021/0290793 A1 * 9/2021 Tung ..... A41D 13/1192
2021/0298387 A1 * 9/2021 De La Guardia ..... A62B 18/02
2021/0307421 A1 * 10/2021 Root ..... A41D 13/1184
2021/0307427 A1 * 10/2021 Rybak ..... A41D 13/1161
2021/0307446 A1 * 10/2021 Baz ..... A42B 3/20
2021/0308496 A1 * 10/2021 Monteleone ..... B01D 39/083
2021/0308499 A1 * 10/2021 Gomes ..... A62B 18/003
2021/0315291 A1 * 10/2021 Votolato ..... A41D 13/1161
2021/0321691 A1 * 10/2021 Sprouse ..... A41D 13/1161
2021/0322799 A1 * 10/2021 Pachoud ..... B03C 3/32
2021/0329998 A1 * 10/2021 Crooks ..... A41D 31/32
2021/0331004 A1 * 10/2021 Levine ..... A41D 13/1107
2021/0331006 A1 * 10/2021 Rajukumar ..... A42B 3/28
2021/0337902 A1 * 11/2021 Friedman ..... A41D 27/24
2021/0339061 A1 * 11/2021 Fajardo ..... A62B 9/00
2021/0345701 A1 * 11/2021 Mamatas ..... A41D 13/1184
2021/0346118 A1 * 11/2021 Kacker ..... A62B 18/02
2021/0346204 A1 * 11/2021 Goldberg ..... A61F 9/027
2021/0353969 A1 * 11/2021 Leschinsky ..... A42B 1/24
2021/0353971 A1 * 11/2021 Lane ..... A41D 13/1184
2021/0361000 A1 * 11/2021 Choi ..... A42B 7/00
2021/0368879 A1 * 12/2021 Motadel ..... A41D 13/1161
2021/0368883 A1 * 12/2021 Stephens ..... B32B 7/08
2021/0368885 A1 * 12/2021 Atri ..... A42B 3/286
2021/0378323 A1 * 12/2021 Zamuruyev ..... A62B 23/025
2021/0378328 A1 * 12/2021 Vieira ..... A41D 13/1161
2021/0378346 A1 * 12/2021 Abghari ..... A61F 9/045
2021/0386137 A1 * 12/2021 Martino ..... A41D 13/1161
2021/0392970 A1 * 12/2021 Basta ..... A41D 13/1184
2021/0402227 A1 * 12/2021 Swonger ..... A62B 18/084

* cited by examiner

RESPIRATORY PROTECTION SYSTEM

STATEMENT REGARDING FEDERALLY SPONSORED RESEARCH OR DEVELOPMENT

The present invention was made with no government support.

RELATED PATENT APPLICATIONS AND INCORPORATION BY REFERENCE

Not applicable

FIELD OF THE INVENTION

The present disclosure relates to the field of respiratory protection devices, including personal respirator shields employing air filter media and PAPR systems.

BACKGROUND OF THE INVENTION

Protection of individuals in all walks of life is vital and, in particular, protection of healthcare workers from exposure to airborne pathogens is of paramount importance. Pandemics such as influenza and COVID-19 pose an even more dangerous threat that heightens the need for protection, such as improved Powered Air Purifying Respirator (PAPR) systems, including masks, face shields, and purified air supplies designed to protect individuals from the transfer of harmful microorganisms, bodily fluids and particulate material. Pathogens, carcinogens, toxins, fine particulate matter and allergens can be found airborne in all medical workplaces, hobby shops, homes, outdoors and in most other environments. The effectiveness and successful deployment of protective masks, face shields, and PAPR systems depends upon several factors, including fit, comfort, efficacy, ease of manufacture and durability, and cost. Traditional face masks have many drawbacks, including causing discomfort and disturbing a wearer's ability to breathe, fogging eyewear and failing to achieve an adequate seal with the face, thus rendering them largely ineffective. Accordingly, there is a need for novel personal protective equipment (PPE) that allows a traditional face mask to be worn in a manner that eliminates the drawbacks of traditional face masks.

A drawback of the traditional PAPR systems is that they are generally too expensive, making them largely inaccessible. Moreover, traditional PAPR pump and filter systems are heavy and bulky. There is a need for a more affordable PAPR system to provide access to people who otherwise cannot afford the traditional PAPR systems available on the market.

Particularly in a world coping with a devastating pandemic, such as COVID-19, there is a need for affordable, efficient and innovative PPE. An improved PAPR system offers great value to the medical community and allows for a safer environment in numerous common and everyday activities, such as travel, work, education, transportation, sports, shopping, and meetings, where individuals are required to come into close physical contact with others. SARS-CoV-2, the virus responsible for the COVID-19 pandemic, is a virus with remarkable resilience, propagation and multiplication characteristics which require complex technological systems, manner, and mannerisms to assure reasonable protections from and eradication of this virus. Simple multi-use face masks are well known as a protective measure taken by many individuals to protect themselves from airborne virus particles, allergens, and foreign matter which might otherwise be inhaled. Also, individuals use these masks to help protect others from pathogens they may otherwise unknowingly expel.

The current generation of masks are often made from non-woven materials, are not particularly comfortable, are not adjustable and do not form a proper seal. For example, if a well fitted high-quality N95 mask is used, a suffocating effect may result due to lack of moving air and the reservoir effect created by a high-volume mask/facial cavity or void. If the user is simultaneously wearing a conventional face shield in conjunction with a face mask, these problems intensify. Utilizing a ventilated face shield makes wearing an N95 mask much more comfortable. Wearing an N95 mask externally attached to a ventilated face shield makes for an even more comfortable, efficient and safe form of PPE. Most people, even trained professional healthcare workers, often touch their face masks and face coverings in an attempt to readjust the fit. This causes users to contact their hands to their face, mouth and nose without realizing they are doing so, which puts the wearer at risk of exposure to the SARS-Cov-2 virus or other potentially harmful contaminants. An improved, forced air face shield could help to eliminate this potential common PPE user failure by eliminating the ability or need of the user to touch the facial area.

Various masks having antibacterial and antiviral effects have also been developed in response to rising concerns arising out of epidemics of colds and influenza and further in response to outbreaks of infectious diseases such as avian influenza and coronavirus. For example, Japanese Patent Publication Nos. 1993-153874 and 1996-325915 disclose nonwoven fabric which is formed of polyolefin fibers containing an inorganic antimicrobial agent. In this nonwoven fabric, however, most of the inorganic antimicrobial agent present inside of the fibers is covered with polyolefin, so that only a small amount of the inorganic antimicrobial agent is exposed to the fiber surface. Therefore, even if this nonwoven fabric is used to form a mask, the antibacterial and antiviral effects of the inorganic antimicrobial agent against pathogens such as bacteria and viruses are not fully achieved. Further, when the mask is worn, the wearer may touch the mask body. In this case, if any bacterium or virus adheres to the outer surface of the mask body and stays on it, the bacterium or virus may cause secondary infection. These types of masks are disadvantageous to the extent that they cannot achieve a high capture efficiency to capture dust, pathogens or other particles in the air, while also allowing for high air permeability for ease of breathing for the wearer. Moreover, the seal on common cloth or surgical face masks often do not seal well around the nose or bearded areas of the face. Other types of protection, including most PAPR helmets, suffer from various other drawbacks, including being too heavy, expensive and bulky, requiring very expensive high air flow pumps and being unsuitable for multiple use arenas.

The known prior art, such as the system disclosed in U.S. Patent App. Publ. No. 2021/0016216, also includes multi-use face masks with valves for inhalation of air from a specialized filter placed in a cleaner air space and an exhalation valve that drives the exhaled air via a tube to a filter bladder attached to the user's wrist and from there a release end near the ground. Alternatively, the exhalation valve may be connected to an aspiration tube that removes the exhaled air and prevents it from recirculating. Some of these types of masks also use an aspiration tube that removes exhaled air and prevents it from recirculating. Such systems must be used while in a stationary, normally sitting position and limit the mobility of the user while the system is in use.

In general, face shields, face masks and PAPR pump filter combinations are known in the prior art, but can be very difficult and expensive to manufacture. Moreover, they lack ease of adjustability, do not form an optimal seal to prevent exposure to pathogens and harmful particulates in the air. With the current worldwide pandemic, there is a serious need for an easy to assemble, economically feasible and one-size-fits-all PAPR face shield system.

Assuming there comes a time the COVID-19 pandemic passes, a need will still exist for improved PPE. Future communicable disease outbreaks and other types of catastrophes and environmental hazards will continue to occur.

In addition to the critical healthcare relief the present invention offers, the present invention also offers practical protections against other potential harms posed by the physical environment. The present invention offers protection against respiratory allergens and prevents wind, cold, rain, hail, sleet and pollen from coming into contact with the wearer's face or respiratory tract. The present invention further provides the wearer fresh air and eye protection while engaging in activities such as sporting, working outdoors, woodworking, mowing, yardwork, skiing, snowmobiling, motoring, bicycling, mountaineering, construction, working with chainsaws and performing demolition jobs. The protection afforded by the present invention is particularly effective as the face shield of the present invention holds securely to the wearer's face, thus allowing for vigorous activity without the fear of an air seal leak or unintentional loosening of the straps. The present invention is further advantageous as it allows the wearer to have his or her face protected without the need to wear a standard facemask in the customary fashion, thus allowing the wearer's face to be visible to others. Visibility of a wearer's face is important as it allows for more effective person-to-person communication, which is not possible when face masks obscure a person's facial expressions. For example, the present invention solves the problem of smiles being hidden by face masks.

SUMMARY OF THE INVENTION

In view of the above, it is an object of the present invention to overcome the shortfalls in the related art by presenting an improved PAPR system that is an unobvious and unique combination, configuration and use of relatively simple components that are easy to manufacture, assemble and use. The disclosed preferred embodiments of the present invention provide a novel PAPR system comprising a lightweight transparent face shield functioning as a protective barrier; an interior tubular foam frame attached to the interior surface of a face shield; an air hose having one end inserted into the foam frame through an orifice bore into the foam frame and an opposite end of the tubing attached to an air supply, such as an automated air pump; a plurality of strap members formed of a flexible, non-stick and self-adhesive tape and a HEPA filter bag used to house the automated air pump and to filter the air introduced into the PAPR system. Further embodiments also include a closeable, multi-component air filtering and pump housing assembly with replaceable filters allowing for up to P100 filtration elements to be utilized. Other objects and features of the invention will be in part apparent and in part specifically described herein.

The disclosed embodiments overcome the failings or shortcomings of the prior art by providing a one-size-fits-all full face PAPR system that is inexpensive, lightweight and more comfortable than other PAPR systems and other PPE known in the art. The face shield of the present invention also accommodates eyewear. The present invention also allows for the user to eat and drink while using the face shield system, which is particularly useful for airline travel and public and private transit systems. The supply hose can receive air from an airliner personal overhead vent or any other air source, automobiles included, if prudent adaptive measures are used to access air from oddly shaped vents or other air supplies. After the initial use, the strap members may remain releasably connected and the face shield will hold its usable shape and fitting, thus creating the possibility of a nearly instantaneous fit of the face shield in future usages. The light weight of the present invention also obviates the need for additional bulky, heavy and costly supportive headgear structure that is typically required to support conventional PAPR PPE hoods.

According to one aspect of one or more embodiments of the present invention, the strap members allow for the mask to be worn like a standard face shield, strapped snugly to create a positive pressure respirator effect or strapped loosely to create a ventilation effect. The strap members can be used to pull the edges of the face shield inwardly toward the user's jaw line and also to pull inward to cover and seal the underneath area between the chin and neck, thus eliminating open areas that would be susceptible to the entry or escape of airborne contaminants. The interior foam frame is also configured in such a manner as to allow the face shield to bend inward and, in concert with a chin strap member, to create a seal around and under the user's chin area. This is achieved by introducing angular 45-degree end cuts of the foam frame. The face shield is then permitted to easily flex inwardly while following this angular form of the frame towards the area underneath the chin, and simultaneously creates a unique seal of frame and face shield and provides an uninterrupted skin surface contact area thus creating a proper seal under the wearer's chin. According to another aspect of the present invention, the strap members are secured at one end to the face shield by rivets that allow the strap members to be pivoted which, in turn, causes the opposite end of the strap member to lie flat upon the opposite attachment point. As a result, the strap member remains flat against the surface of the face shield while used in various positions, providing a proper adhesion point alignment. The strap members are also suitable for repeated use.

Another aspect of the present invention allows for the user to wear an N95 mask or similar oval-style common mask externally and underneath the opening at the bottom of the face shield to serve as an exhaust air external filter. The user may also utilize a standard face mask which may be worn in the conventional manner directly over the user's mouth and nose, while also wearing the face shield.

Another aspect of the disclosed embodiments of the present invention is that it can be used for any purpose where filtered or fresh air is required. The PAPR system of the present invention advantageously requires much less air supply volume than standard PAPR hoods, due to the much smaller air volume within the face shield that needs to be continuously replenished as compared to the air volume in a standard PAPR hood. Stale air cannot build up in the interior of the face shield of the present invention due to the low volume of the cavity formed inside the face shield. Even with no forced air supply, the low volume of air in the face shield still allows normal breathing to evacuate stale air and to intake fresh air, without the risk of suffocation posed by many common PAPR hoods because of their larger size.

According to yet another aspect of the disclosed embodiments of the present invention, the PAPR system includes a unique filter system that uses a non-woven HEPA cloth filter bag that functions as a container as well as an air filter. The HEPA cloth filter/container may optionally include a clear, see-through panel allowing for visibility of the container's contents and further allowing touch access to blower/battery function buttons of the portable pump for controlling operation variables such as blower speed and power control. The HEPA cloth filter bag is designed to carry items, such as a low power air pump, additional replacement filtration elements, a power supply, and batteries. The HEPA cloth filter bag can also be used to contain additional items, such as spare face masks and various types of portable breathing machines and oxygen generators. When the HEPA filter bag contains a breathing machine, such as a cpap or bipap breathing machine, the filter bag may act as an air filter and containment buffer, thus obviating the need for replacement of internal cpap or bipap filters. The HEPA filter bag has a relatively large filter surface area that allows for the use of a relatively low power air pump. Typically, PAPR filters and pumps are very expensive. A large surface area is normally required for adequate airflow, which creates the problem of having to take a large surface area of filtration material and folding and manipulating the filtration material to fit within a small housing. Alternatively, known PAPR systems may require the use of a very large, heavy, and expensive higher power pump with a less breathable filtration material to achieve adequate airflow.

The present invention eliminates the need for this expensive and impractical style of air filter. Also, the low power air pump and HEPA cloth filter/container are small enough to be worn comfortably under protective garments, such as a PPE suit. The HEPA cloth filter bag may be stowed in a purse, backpack, waist pouch or any other container. The filter pouch may also be clipped directly to a waist belt or worn with an integral shoulder strap or carried with an integral filter bag handle. Being cloth, the filter container may be decorated with patterns or art and remain functional. The filter bag or container may be sealed with a drawstring type closer, a zip seal type closer, a magnetic strip seal, or by any other method to tightly seal the filter bag/pouch/or container hose entry orifice at the hose entry junction point.

Another aspect of the preferred embodiments of the present invention allows for self-adhesive medical protective garments to be applied to the face shield in a manner that prevents splatter from coming into direct contact with the user's skin, clothing or external exhalation filter and when tucked under outer garment is able to then direct exhaled air into the user's protective garments, i.e., a PPE or hazmat suit.

DETAILED DESCRIPTION

Figure 1:
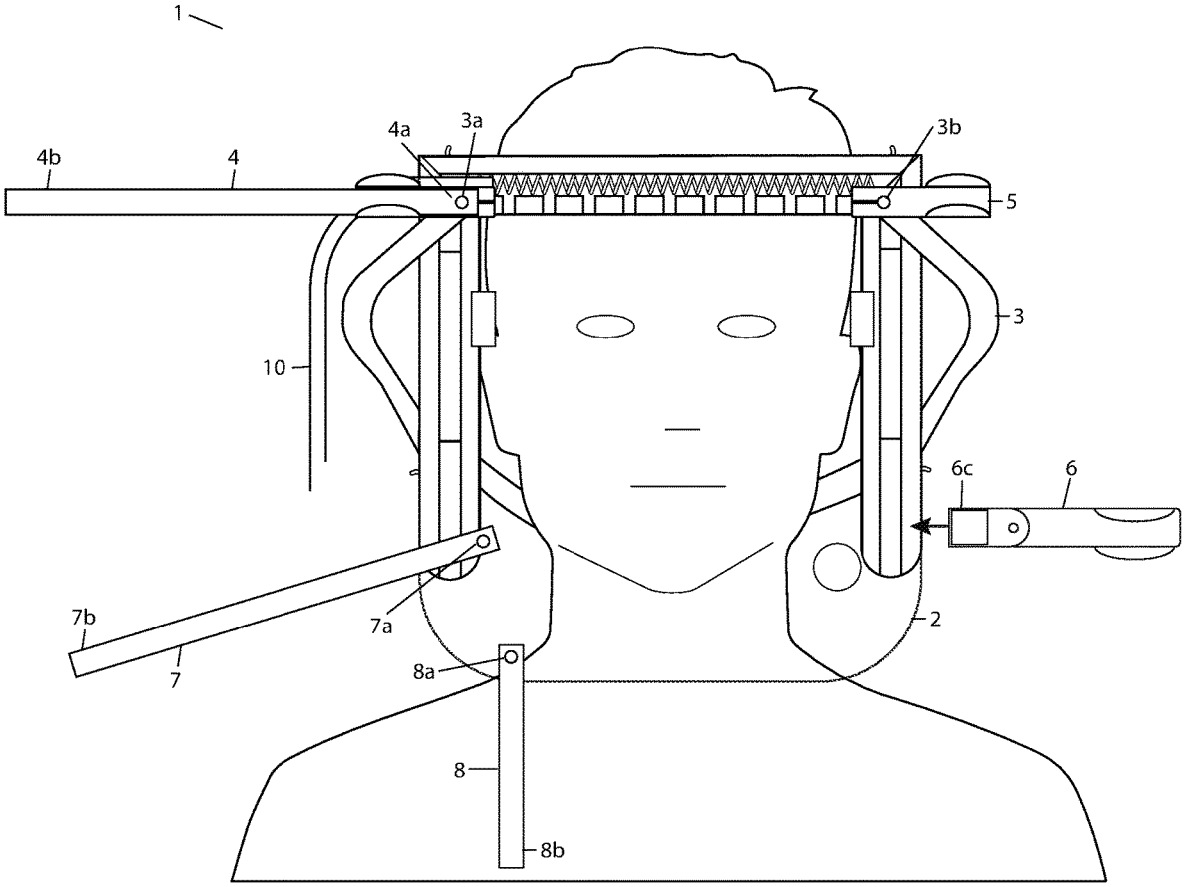
FIG. 1 is a front perspective view of a face shield of an embodiment of the invention, showing the strap members in an unsecured position.

The following detailed description is merely exemplary in nature and is not intended to and should not be interpreted to limit the embodiments described herein. Although particular embodiments are described, those embodiments are merely exemplary implementations of the system of the present invention. The following descriptions and illustrations herein should be considered illustrative in nature, and thus, not in any way limiting the scope of the present invention. One skilled in the art will recognize other embodiments are possible and all such embodiments are intended to fall within the scope of the present disclosure. While the preferred embodiments are described with reference to the above drawings, there is no intent to limit the disclosure to the embodiments shown in the drawings or disclosed herein. Rather, the intent is to include all alternatives, modifications and equivalents that embody the spirit and scope of the disclosure.

It is also to be understood that the disclosure uses terminology for the purpose of describing particular embodiments and such terminology is not intended to be limiting.

Unless defined otherwise, all technical and scientific terms used in this disclosure have the same meaning as commonly understood by one of ordinary skill in the art to which is applicable to this disclosure.

As will be apparent to those of skill in the art upon reading this disclosure, each of the embodiments described and illustrated herein has discrete components and features which may be readily separated or combined with features of any of the other possible embodiments without departing from the spirit and scope of the present disclosure.

FIG. 1 shows a perspective view of a protective face shield system 1 in use according to one or more embodiments of the present invention. The protective face shield system 1 includes a transparent face shield 2. The face shield 2 may be completely transparent or, alternatively, may be tinted. The transparent face shield 2 is preferably comprised of a suitable flexible material, such as high-quality clear polycarbonate or polyester film. The transparent face shield 2 can be made from any other known lightweight, transparent plastic material. As further illustrated in FIG. 1, a first strap member 3 may be fixedly attached to the face shield 2 at a first end 3*a* and a second end 3*b*, preferably by riveting. Riveting is the preferred method of securing the first and second ends of the first strap member 3 to the face shield 2. However, any other known method of securing the first and second ends of the strap member 3 to the face shield 2 may also be employed, including glue or use of a snap fit.

Figure 5:
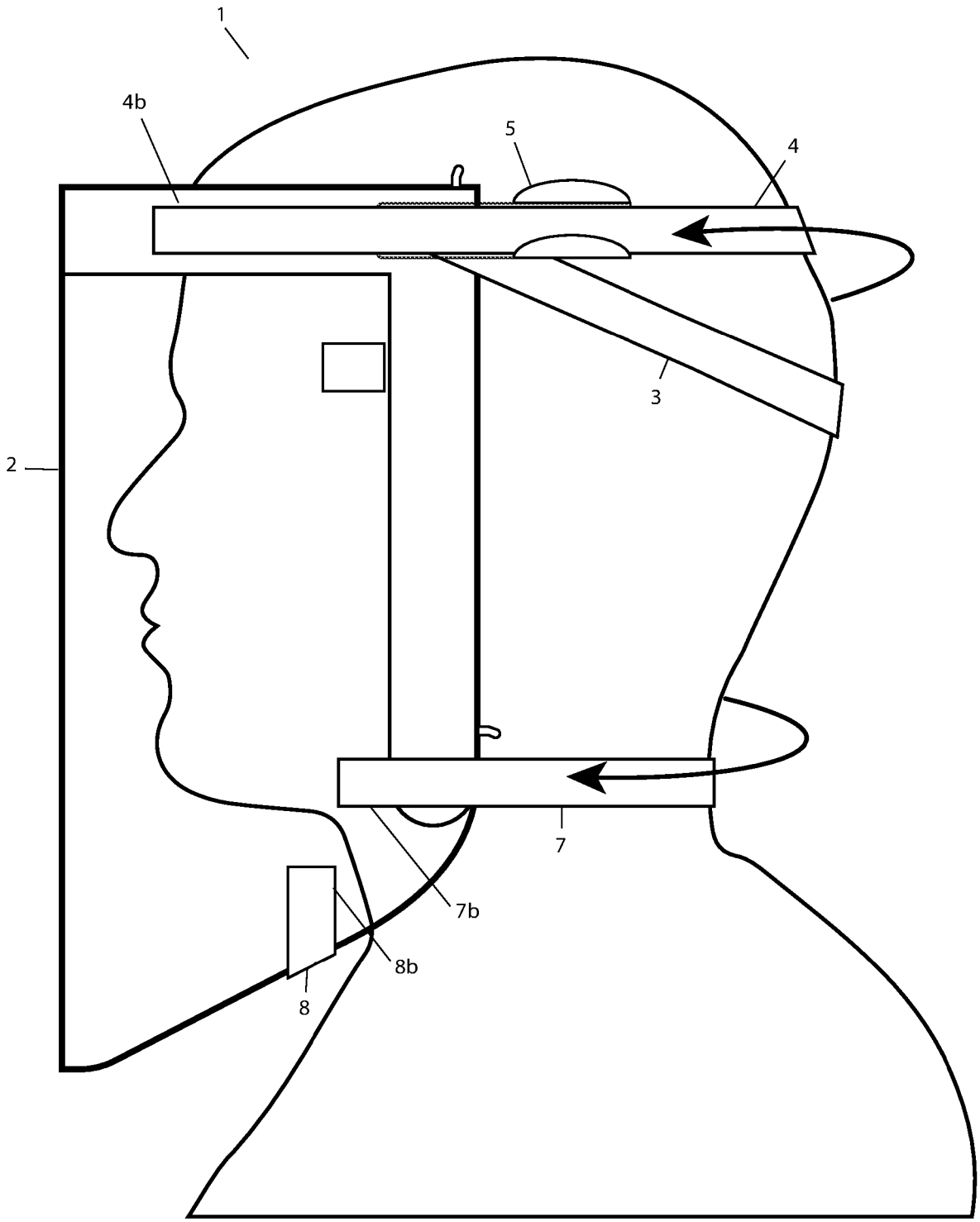
FIG. 5 is a side perspective view of the face shield of an embodiment of the invention with the first, second and third strap members in an attached position.

As further shown in the preferred embodiment illustrated in FIGS. 1 and 5, a second strap member 4 is attached to the face shield 2 to aid in securing the face shield 2 to the wearer's head. FIG. 1 shows a flexible, non-stick and self-adhesive second strap member 4 that may be fixedly attached to the face shield 2 at its first end 4*a* and releasably attached at its second end 4*b*. The first end 4*a* of the second strap member 4 is fixedly secured to the face shield 2. The embodiment of FIG. 1 shows riveting as the method of securing the first end 4*a* of the second strap member 4 to the face shield 2 because it allows for the second strap member 4 to be pivoted into different directions. However, any other known method of securing the first end 4*a* of the second strap member 4 to the face shield 2 may also be employed, including glue or use of a snap fit, by way of example. The second end 4*b* of the second strap member 4 is preferably releasably attached to the face shield 2 by virtue of the self-adhesive nature of the second strap member 4. This self-adhesive attachment of the second end 4*b* of the second strap member 4 to the face shield 2 may be achieved, for example, by using a suitable self-adhesive tape, such as Hugo's Amazing Tape®, as the second strap member 4. Any other self-adhesive tape or other suitable strap material would be suitable for use as the second strap member 4 or for use as the third and fourth strap members 7, 8 disclosed herein. The second strap member 4 advantageously adheres on contact, demonstrates great lateral holding power, is easily removable when pulled away from adhesion points and is reusable.

Figure 3:
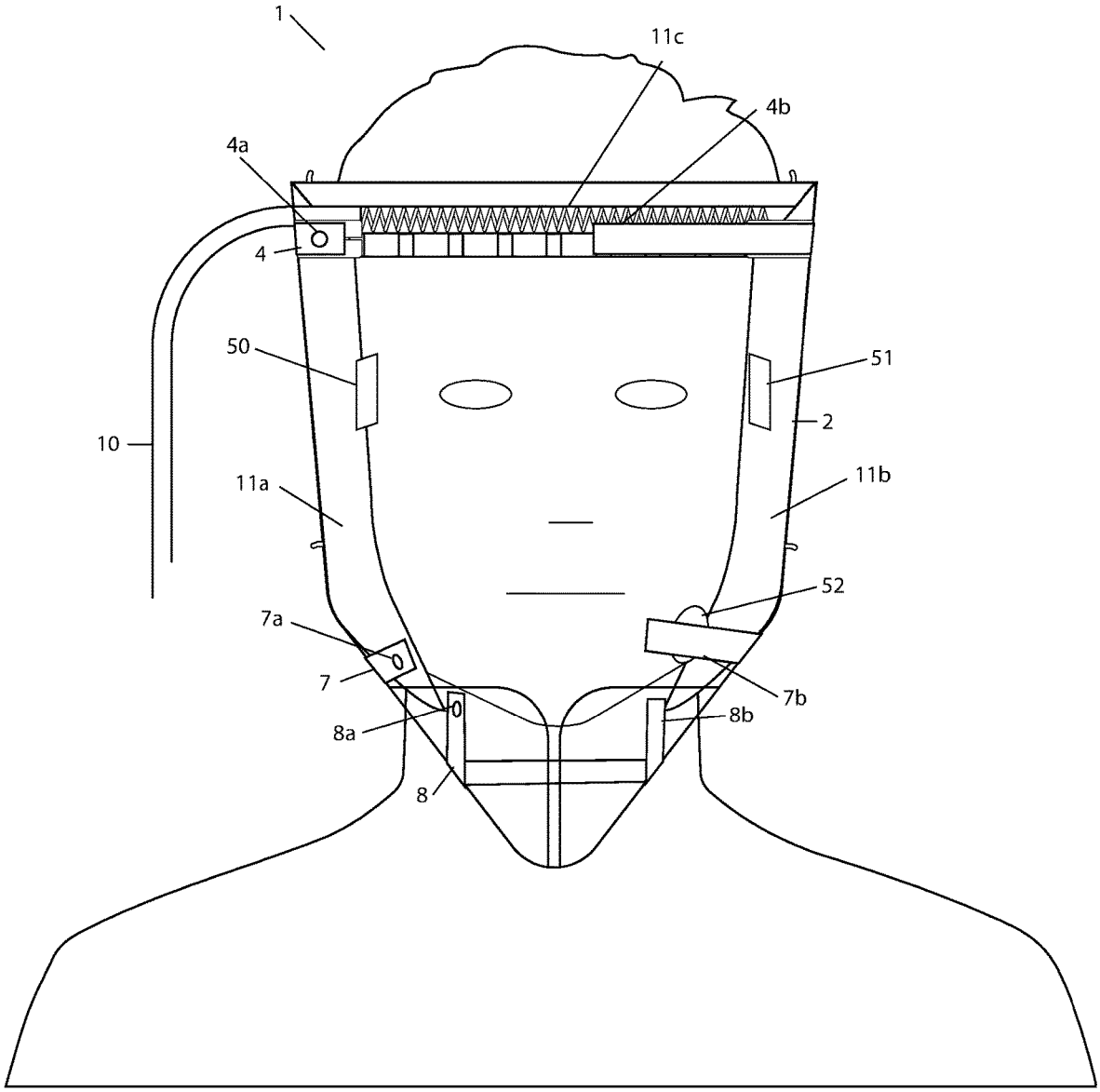
FIG. 3 is a front perspective view of the face shield of an embodiment of the invention with the first, second and third strap members in a secured position.

By securing the second strap member 4 in the closed position, as shown in FIG. 3, the face shield 2 may be firmly secured to the wearer's head. Unlike conventional straps used for face shields and the like, the self-adhesive second strap member 4 of the present invention allows for quick and easy adjustment of the strap 4 to achieve the desired fit to the wearer's head and face profile. As shown in FIG. 3, the second strap member 4 may be secured tight enough to pull the edges of the face shield 2 inwardly toward the user's ears and neck, thus decreasing the open area at the bottom of the face shield 2 that would be susceptible to the entry of airborne contaminants. The embodiment illustrated in FIG. 4 also shows how the face shield system 1 accommodates the wearing of a standard face mask 9 to further cover the opening at the bottom of the face shield 2, thus providing the wearer and others additional protection from airborne contaminants.

Figure 7A:
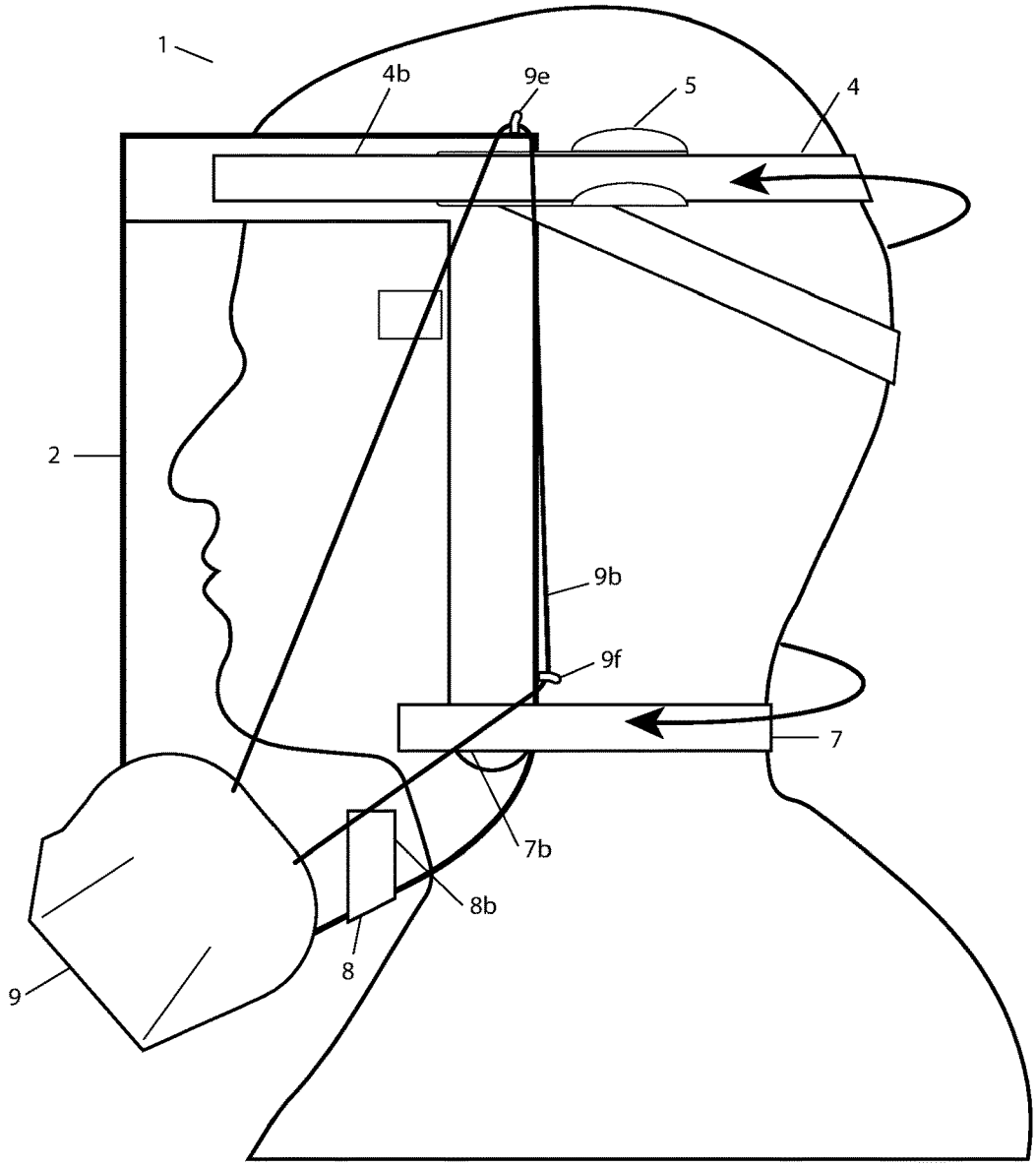
FIG. 7*a* is a side perspective view of the face shield of an embodiment of the invention with the first, second and third strap members in an attached position and having a conventional face mask secured to the face shield.
Figure 7B:
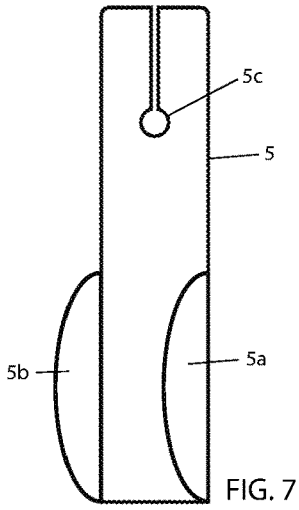
FIG. 7*b* is a front view of a strap member plastic guide of an embodiment of the invention.
Figure 7C:
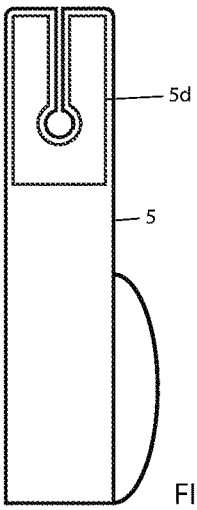
FIG. 7*c* is a rear view of a strap member plastic guide of an embodiment of the invention.

In the case of the embodiment shown in FIG. 7*a*, a rigid polycarbonate plastic piece forms a leverage extension strip 5. The leverage extension strip 5 can be secured to the face shield 2 by adhesive tape or other suitable means of fastening. The second end 4*b* of the second strap member 4 may be guided and secured in place by the strap guides 5*a*, 5*b* on the leverage extension strip 5, as shown in FIG. 7*a*. This configuration of the second strap member 4 allows for the second strap member 4 to pull inwards on the temporal area of the face shield 2 seal. As shown in FIG. 7*b*, the leverage extension strip 5 preferably has two opposing semi-circular-shaped guides 5*a*, 5*b* that aid in keeping the second strap member 4 in place and secured within leverage extension strip 5. FIG. 7*b* also shows a small hole and slit 5*c* which may allow the leverage extension strip 5 to be installed onto the face shield 2 by way of a rivet or other suitable fastening means being positioned through the small hole and slit 5*c* and fixably attached to the face shield 2. The hole and slit 5*c* also allow for installation of a leverage extension strip 5 installation in combination with pre-existing rivets, thus rendering the leverage extension strip 5 as an optional component. Alternatively, an adhesive may be applied to the backing 5*d* of the leverage extension strip 5 to secure the leverage extension strip 5 to the face shield 2.

FIGS. 1-4 further show a third strap member 7 that is secured to the face shield 2 in the same manner as the second strap member 4, as described above, wherein a first end 7*a* of the third strap member 7 is fixedly attached to the face shield 2 and a second end 7*b* of the third strap member 7 is releasably secured to the face shield 2.

FIG. 1 also shows an alternative strap connection point for the second end 7*b* of the third strap member 7. An optional connection point for the second end 7*b* of the third strap member 7 to the second extension strip 6 is also shown. This optional second extension strip 6 may be constructed from thin polycarbonate material, similar to material that is suitable for the face shield 2. This second extension strip 6 is comprised of a mounting portion 6*c* mounted to the face shield 2 with an adhesive, such as adhesive tape or other means. A rivet 6*b* is used to join the main portion of the second extension strip 6 to the mounting portion 6*c*, thus allowing a pivoting action of the second extension strip 6. This pivoting action of the second extension strip 6 allows for proper alignment of the third strap member 7 and further allows for releasable connection of the second end 7*b* of the third strap member 7 with the second extension strip 6. This method of strapping allows usage without any interference of the third strap member 7 obscuring eyesight and is an alternative method of connecting the second end 7*b* of the third strap member 7 to tighten and secure the face shield 2.

FIGS. 1-4 also show a fourth strap member 8 that functions as a chin strap to, along with the curvature of the bottom portion of the face shield 2, create a seal around and under the wearer's chin area and, thus, help prevent airborne particulates and contaminants from entering or exiting the interior area underneath the face shield 2. A first end 8*a* of the fourth strap member 8 is fixedly attached to the face shield 2, in the same manner the first end 4*a* of the first strap member 4 is secured to the face shield 2 (as described above), and a second end 8*b* of the fourth strap member 8 may be releasably secured to the face shield 2 by virtue of the self-adhesive nature of the fourth strap member 8. The seal created by the fourth strap member 8 also advantageously directs all air towards an opened air exit vent that is formed by utilizing the fourth strap member 8 in flexing the face shield material under the wearer's chin, which promotes the ability to filter exhaled air by means of an externally worn air filter.

Figure 4:
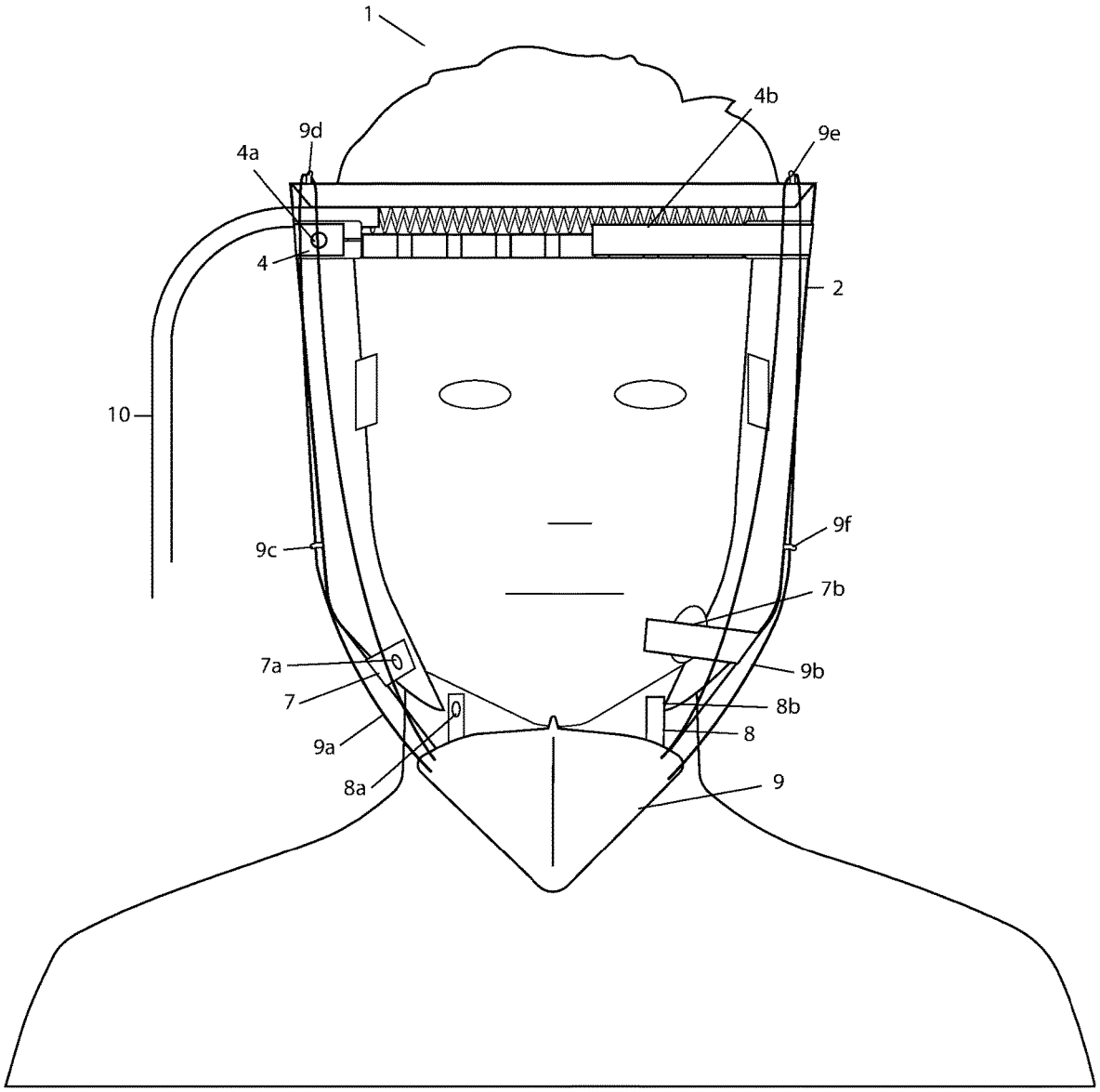
FIG. 4 is a front perspective view of the face shield of an embodiment of the invention with the first, second and third strap members in a secured position and having a conventional face mask secured to the face shield.
Figures 6, 6A:
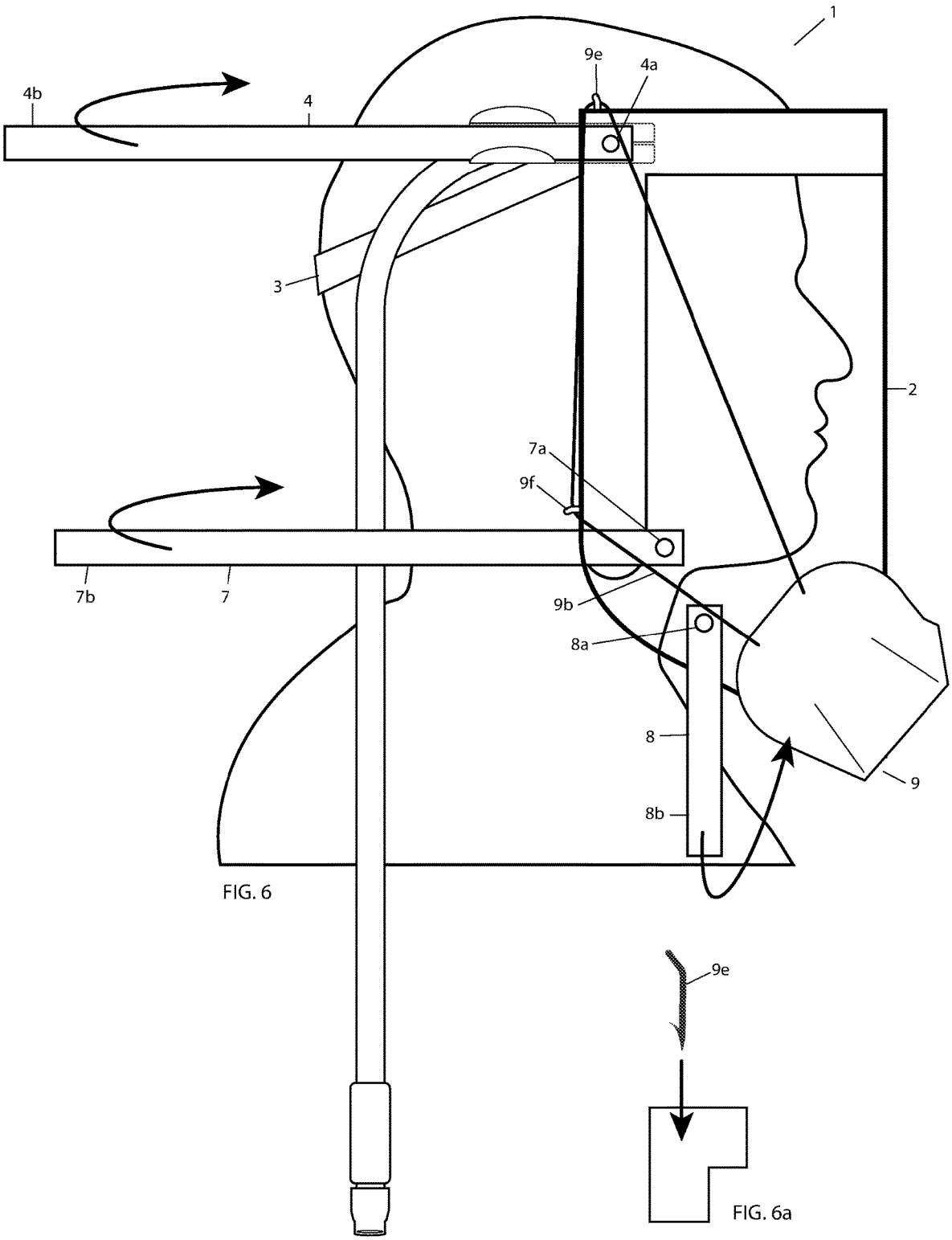
FIG. 6 is a side perspective view of the face shield of an embodiment of the invention with the first, second and third strap members in an attached position and an air hose fitted to the foam frame.
FIG. 6*a* is an illustration showing the manner in which the strapping pin may be engaged in the foam frame.

FIG. 4 shows the manner in which a conventional face mask 9 can be worn over the bottom of the face shield 2 to provide the user further protection from air borne contaminants. The embodiment of the present invention shown in FIG. 4 includes a series of pins 9*c*, 9*d*, 9*e*, 9*f* that allow for the straps 9*a*, 9*b* of the conventional face mask 9 to secure the conventional face mask 9 to the face shield 2. The pins 9*c*, 9*d*, 9*e*, 9*f* can be secured to the face shield by any suitable means, such as welding, or may be held into place by insertion into the foam frame member as shown in FIG. 6*a*. The externally worn mask 9 covers an exhaust vent, thus creating pathogen transmission protection from the wearer to others.

Figure 8A:
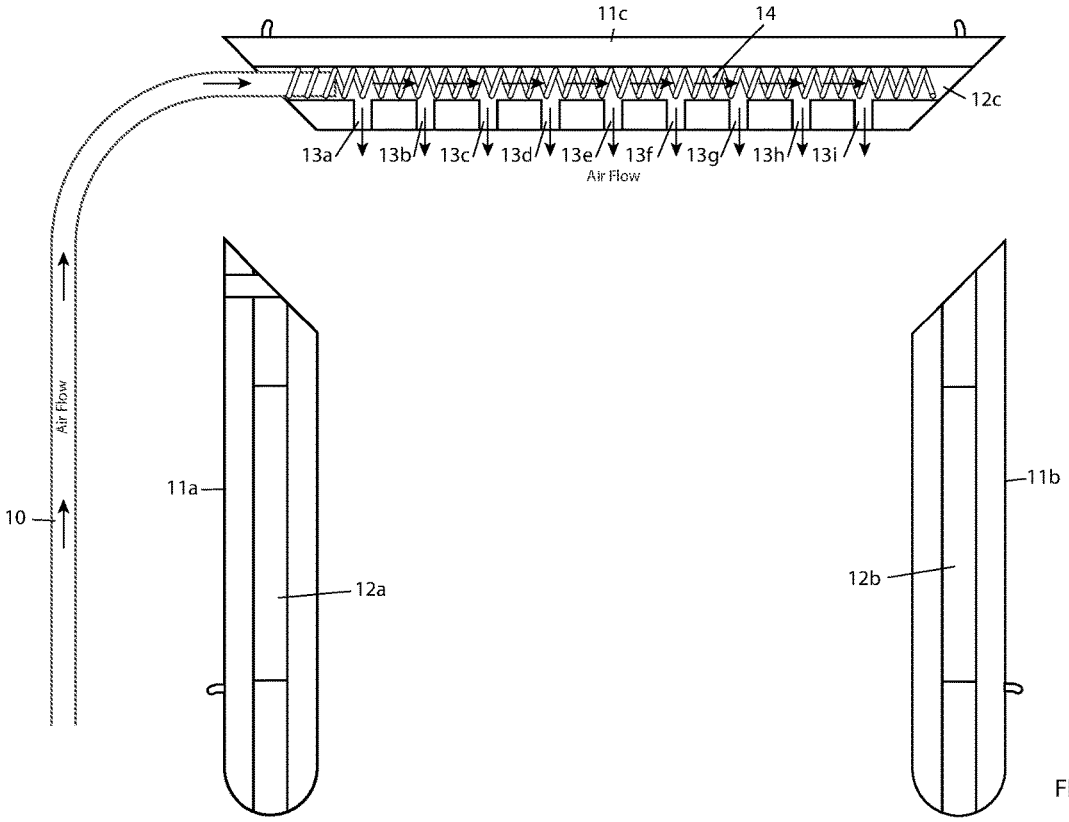
FIG. 8*a* is a front view of a disassembled tubular foam frame of an embodiment of the invention.
Figure 19A:
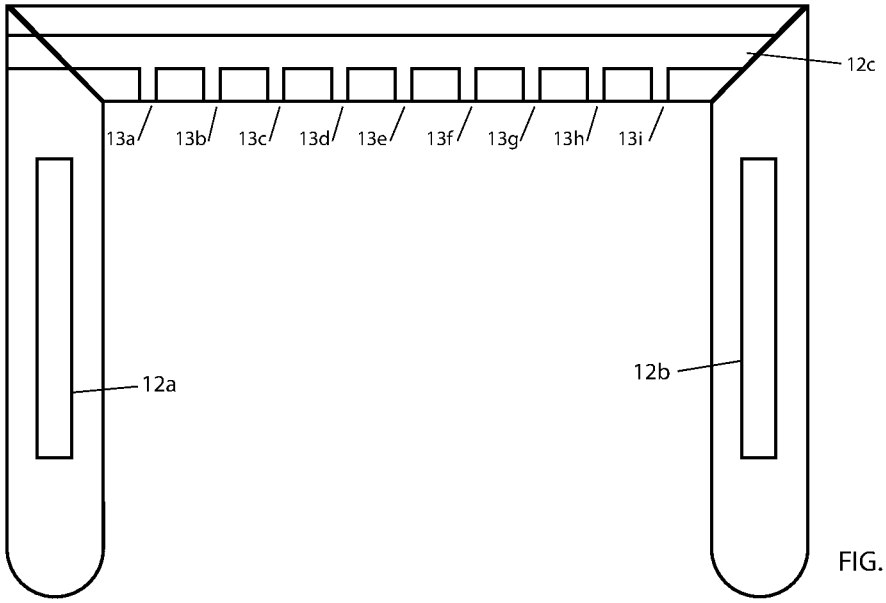
FIG. 19*a* is a front view of a single piece foam frame assembly of an embodiment of the invention.
Figure 19B:
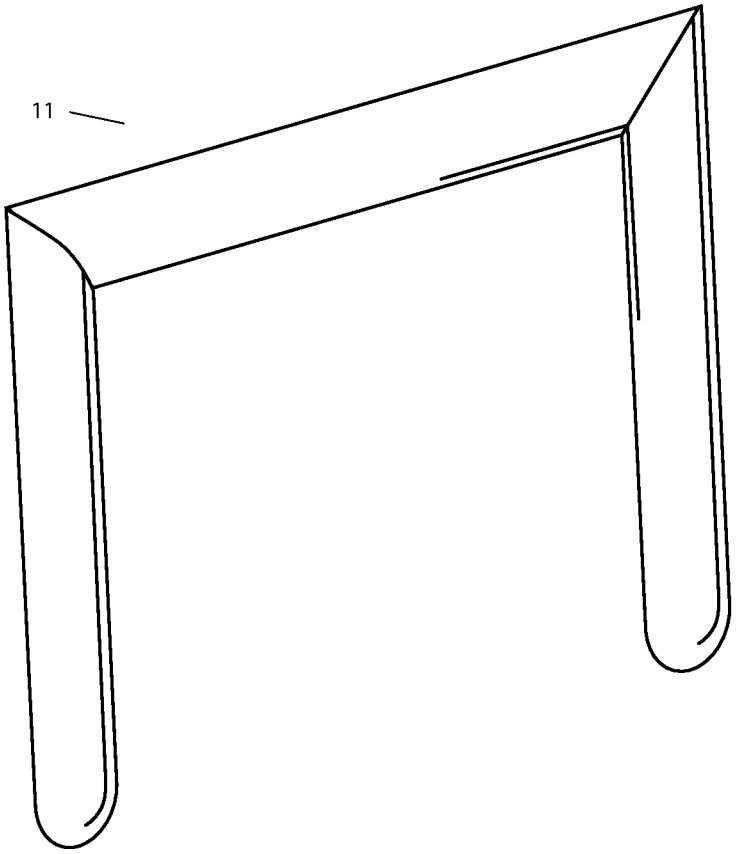
FIG. 19*b* is a rear view of a single piece foam frame assembly of an embodiment of the invention.
Figure 19C:
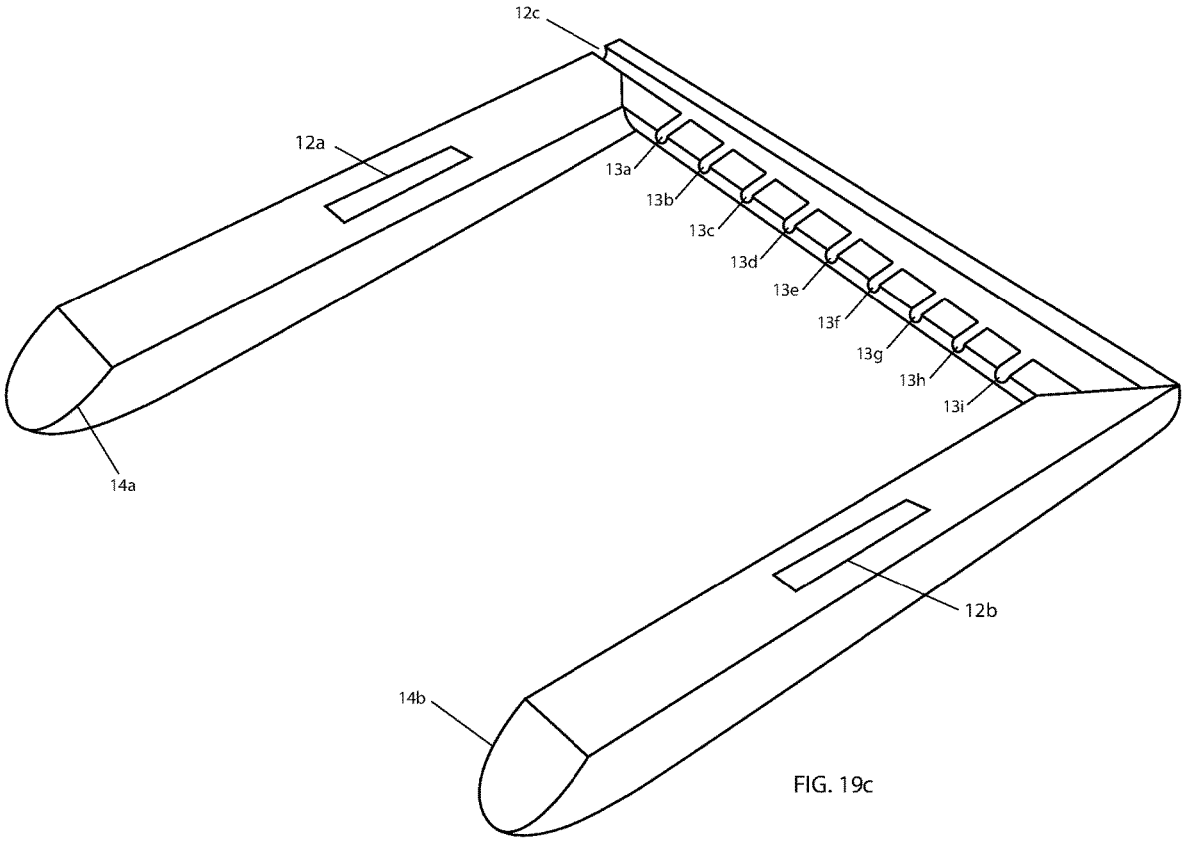
FIG. 19*c* is a perspective view of a foam frame assembly of an embodiment of the invention.

FIG. 8*a* shows an interior tubular foam frame that is adhered to the interior of the face shield and is disposed between the face shield and the wearer's face (as shown in FIGS. 1-6). The disassembled tubular foam frame shown in FIG. 8*a* is comprised of a first tubular foam piece 11*a* and a second tubular foam piece 11*b* positioned parallel to one another and each adhered to opposite ends of the face shield. A third foam piece 11*c* is provided and is also adhered to the interior of the face shield 2 and is positioned perpendicular to the opposing first 11*a* and second 11*b* foam shield piece, and further attached to the first 11*a* and second 11*b* foam pieces to form a substantially upside-down U-shaped foam frame 11. An alternative embodiment may employ a solitary, upside-down U-shaped tubular foam frame 11 (shown in FIGS. 19*a* and 19*b*). For the tubular foam frame 11, the bottom of the first and second tubular foam pieces 11*a*, 11*b* are enclosed, as shown in the preferred embodiment of FIG. 8*a*. The vertical foam pieces 11*a*, 11*b* are isolated from the horizontal foam piece 11*c* by means of a barrier to air flow. Alternatively, the bottom of each of the first and second tubular foam pieces 11*a*, 11*b* may have an opening that is enclosed and sealed with elastic tape or any other suitable means of sealing an open end of each foam piece 11*a*, 11*b*. FIG. 8*c* illustrates a cut away cross section of the tubular foam pieces, which illustrates the semi-circular shaped canal 12*a*, 12*b*, 12*c* within each respective tubular foam piece 11*a*, 11*b*, 11*c*.

As shown in FIG. 8*a*, the semi-circular shaped vents 13*a*, 13*b*, 13*c*, 13*d*, 13*e*, 13*f*, 13*g*, 13*h*, 13*i* are disposed along the edge of the horizontal tubular foam piece 11*c* to allow for filtered air pumped through the tubing 10 and into the tubular foam frame 11 to be, in turn, introduced from the inside of the tubular foam frame 11 and into the area inside the face shield 2. When the protective face shield 1 is in use, the forced air enters the facial cavity of the face shield 2 through these vents 13*a*, 13*b*, 13*c*, 13*d*, 13*e*, 13*f*, 13*g*, 13*h*, 13*i*. The airflow then travels downwards to be ejected from the mask through the exhaust vent created when the fourth strap member 8 is fully engaged, as shown in FIG. 3.

Figure 8B:
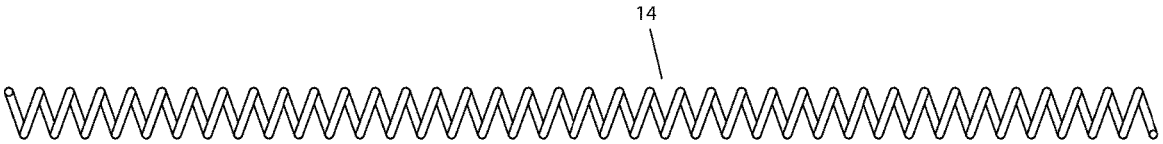
FIG. 8*b* is an illustration of a coiled compression spring of an embodiment of the invention.
Figure 8C:
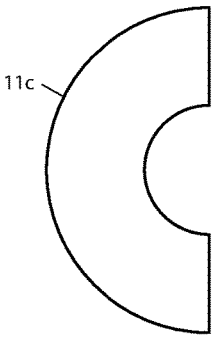
FIG. 8*c* is a cut away cross section of the foam frame of an embodiment of the invention.

FIGS. 8*a* and 8*b* shows a coiled plastic compression spring 14 which is installed along the width of the horizontal foam piece 11*c*. The spring stock acts as an anti-crush device to prevent the frame venting channel 11*c* from collapsing if the protective face shield 1 is strapped on tightly, thus ensuring consistent, non-restricted airflow to the wearer. Further, the interior rim of the foam frame 11 is intentionally not adhered or mounted. This allows the foam frame inside edge and face shield contact area to become semi moveable with respect to the face shield 2, thus allowing the seal to optimally conform to the wearer's facial structure.

Figure 17:
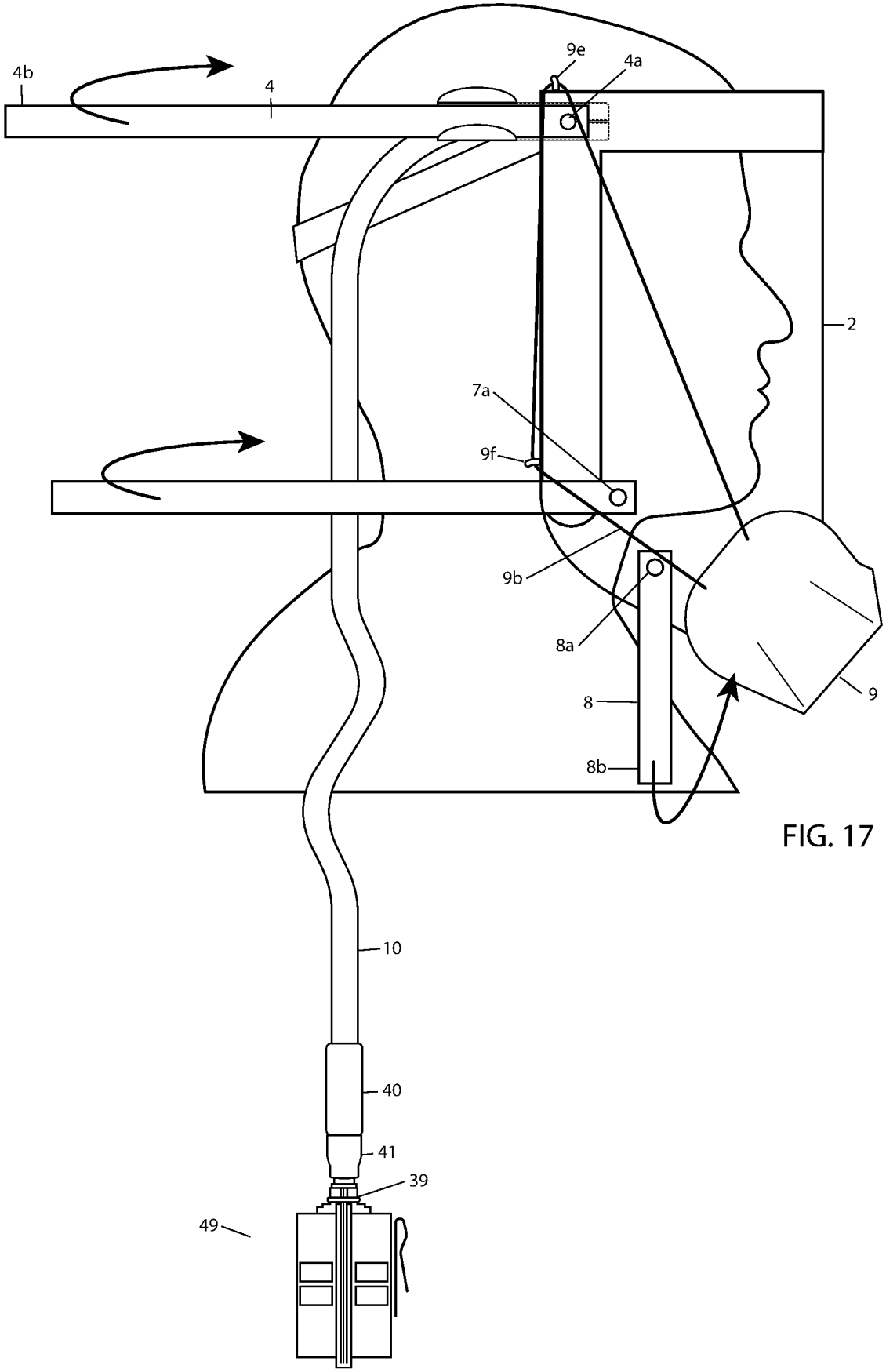
FIG. 17 is a is a side perspective view of an embodiment of the invention with the face shield having the first, second and third strap members in a secured position, a conventional face mask secured to the face shield and the air hose operably connected to a portable pump secured inside the portable pump housing.
Figure 18:
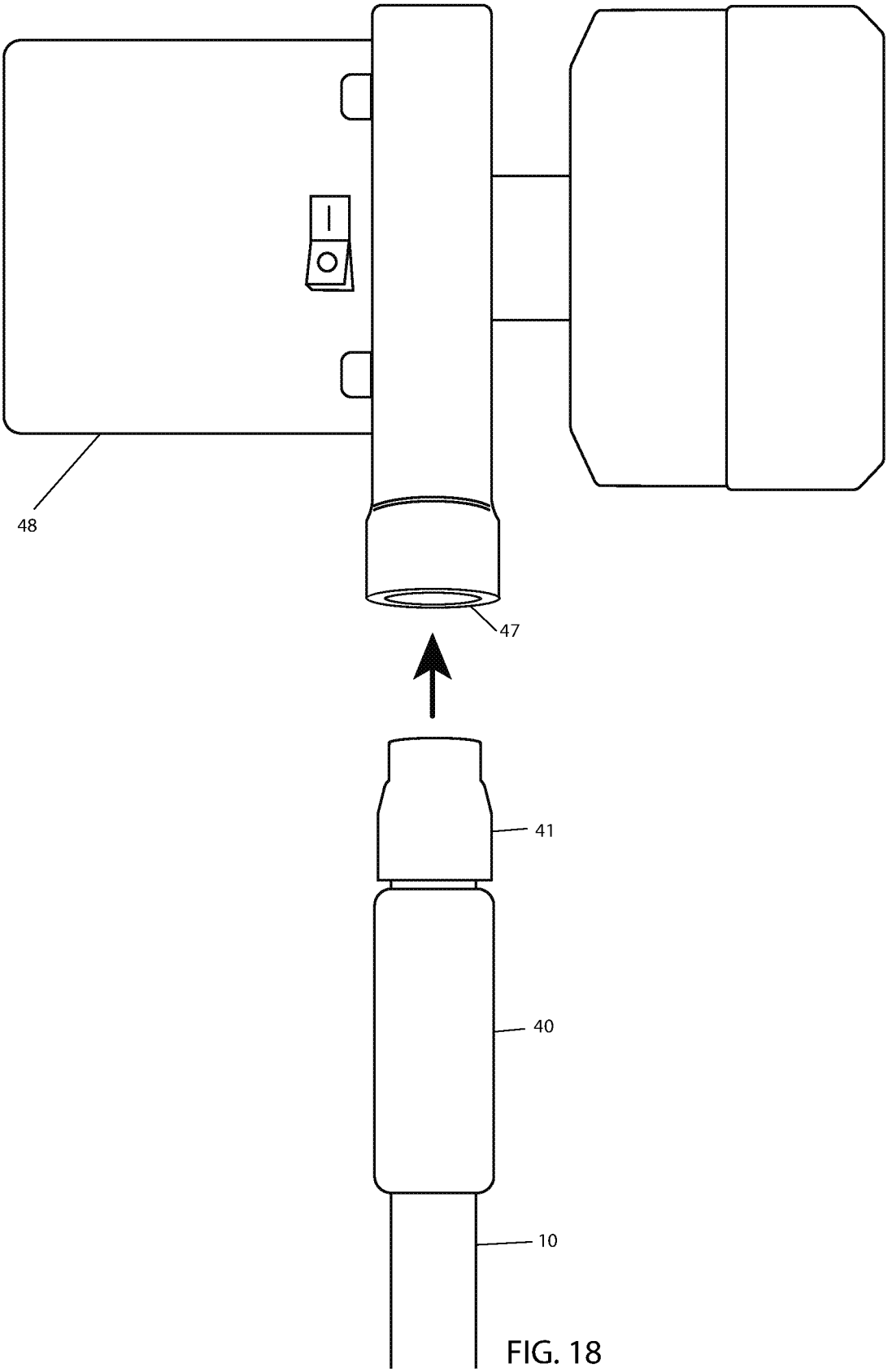
FIG. 18 is an illustration showing in one embodiment of the invention how the air hose is connected to a portable air pump.

FIG. 8*a* further shows a hose 10, which allows for filtered air to be introduced through the tubular foam frame 11 and into the space enclosed by the face shield 2. A first end of the hose 10 is inserted into and held in place by a hole that is bored into either one of the interior foam frame pieces 11*a*, 11*b* (see FIG. 9*b*) and continues through the vent 12*c* in the uppermost tubular foam frame member 11*c*. As shown in FIG. 17, the second end of the hose 10 is attached to a filtered air supply, such as a low power air pump 35 or a personal air vent positioned above a passenger on an airplane. One skilled in the art would understand any standard tubing, such as ultra-lightweight CPAP tubing or a standard CPAP hose, would be suitable for use as the hose 10 of the present invention.

Figure 2:
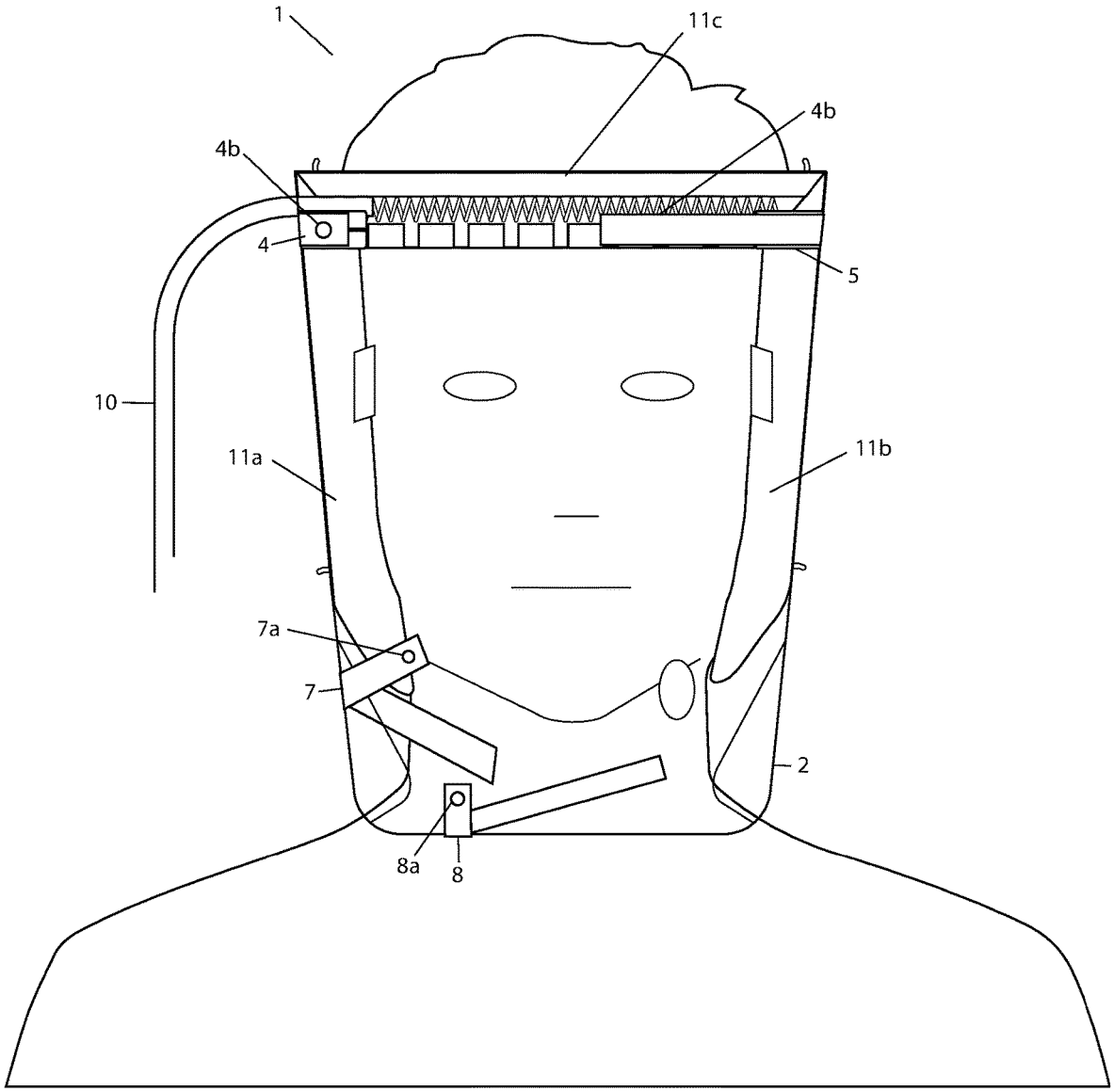
FIG. 2 is a front perspective view of the face shield of an embodiment of the invention in use, with the second strap member in a secured position.

FIG. 2 illustrates how the first and second tubular foam pieces 11*a*, 11*b* are positioned at opposite sides of the face shield 2. When the protective face shield 1 is in use and in a closed position and the first and second strap members are secured rather tightly around the wearer's head, as shown in FIG. 2, the first and second tubular foam pieces 11*a*, 11*b* are firmly positioned in between the wearer's face and the face shield 2, thus forming a seal around the wearer's face that prevents entry of airborne particulates and contaminants into the area inside the face shield 2. This seal further prevents the expulsion of airborne particulates and contaminants expelled by the wearer and allows for the wearer's exhaled air to be filtered. Furthermore, as filtered air flows through the tubular foam frame 11, the air is dispersed through multiple downward pointing jets. This results in airflow planing downward within the interior portion of the face shield 2. Consequently, bothersome air is not directed towards the user's eyes or face. In addition, when an adequate air volume is applied to the mask foam frame 11, the user will have air supplied in sufficient quantity so as not to deplete the positive pressure created by the air supply to mask. This prevents the wearer from inhaling any air originating from the air exhaust vent.

Figure 9A:
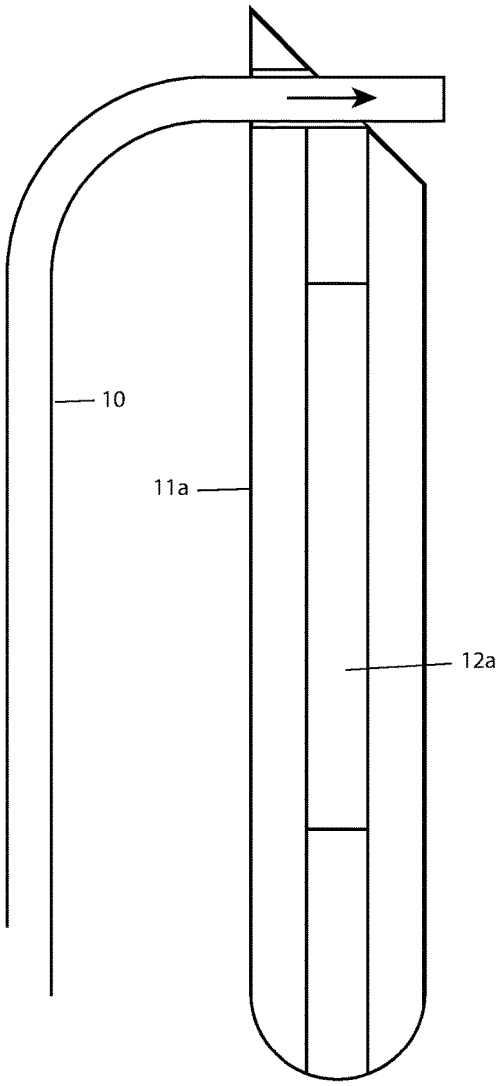
FIG. 9*a* is a front view of a foam frame member that receives an air hose through which filtered air is directed into the face shield of an embodiment of the invention.
Figure 9B:
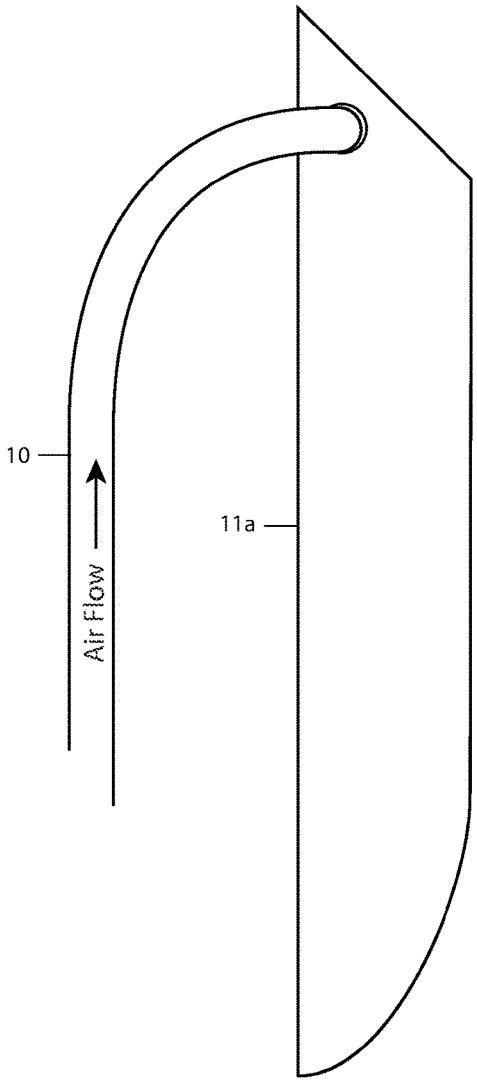
FIG. 9*b* is a rear view of a foam frame member that receives an air hose through which filtered air is directed into the face shield of an embodiment of the invention.

FIGS. 9*a* and 9*b* illustrate the manner in which the hose 10 is fitted at one end through a hole bored into one of the opposing tubular foam frame members 11*a* and, as shown in FIG. 17, the opposing end of the hose 10 is adapted to be inserted into a portable air pump 35. Any common CPAP or BI-PAP machine or any other known conventional breathing machine or portable air pump may be used as the source of air to be supplied to the face shield respirator.

Figure 13A:
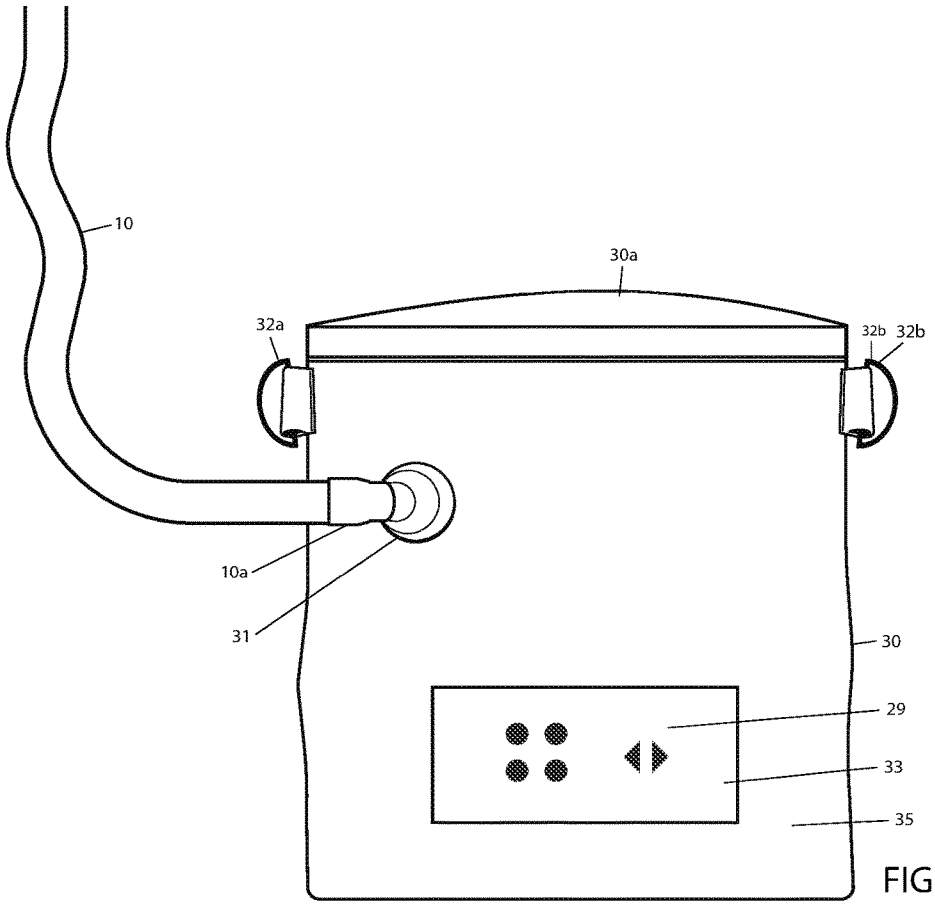
FIG. 13*a* is an illustration of a front view of a HEPA filter bag of an embodiment of the invention having a portable air pump housed therein.
Figure 16A:
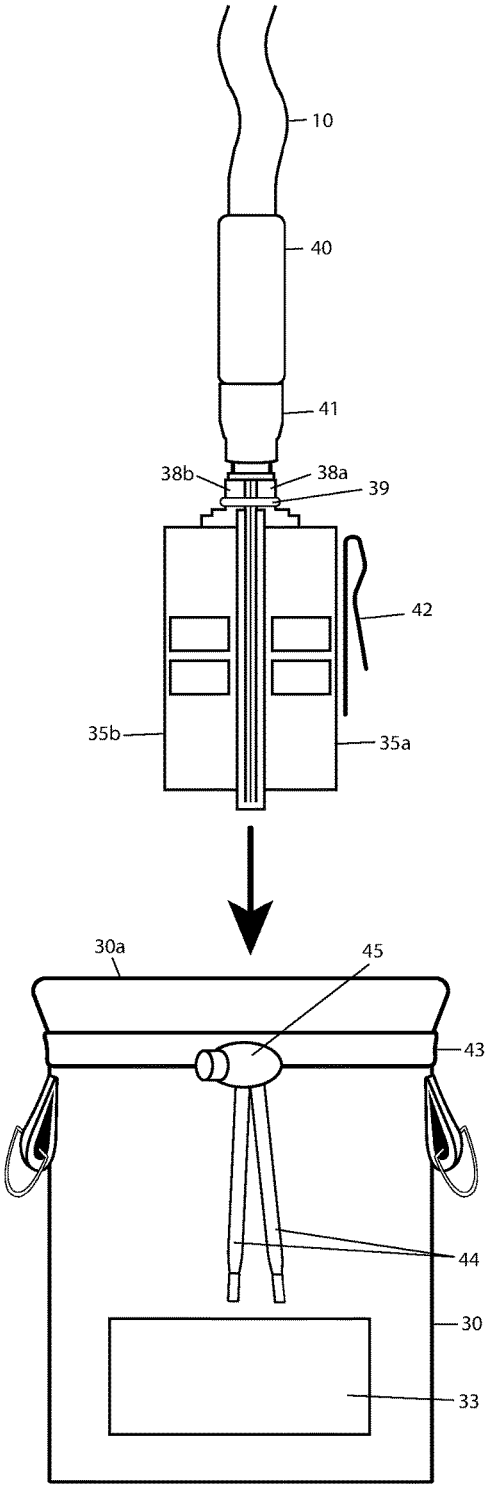
FIG. 16*a* is a side view of the portable pump housing in a shut position and an illustration of how the air hose is attached to the portable pump and how the portable pump housing is inserted into a HEPA filter bag.
Figure 16B:
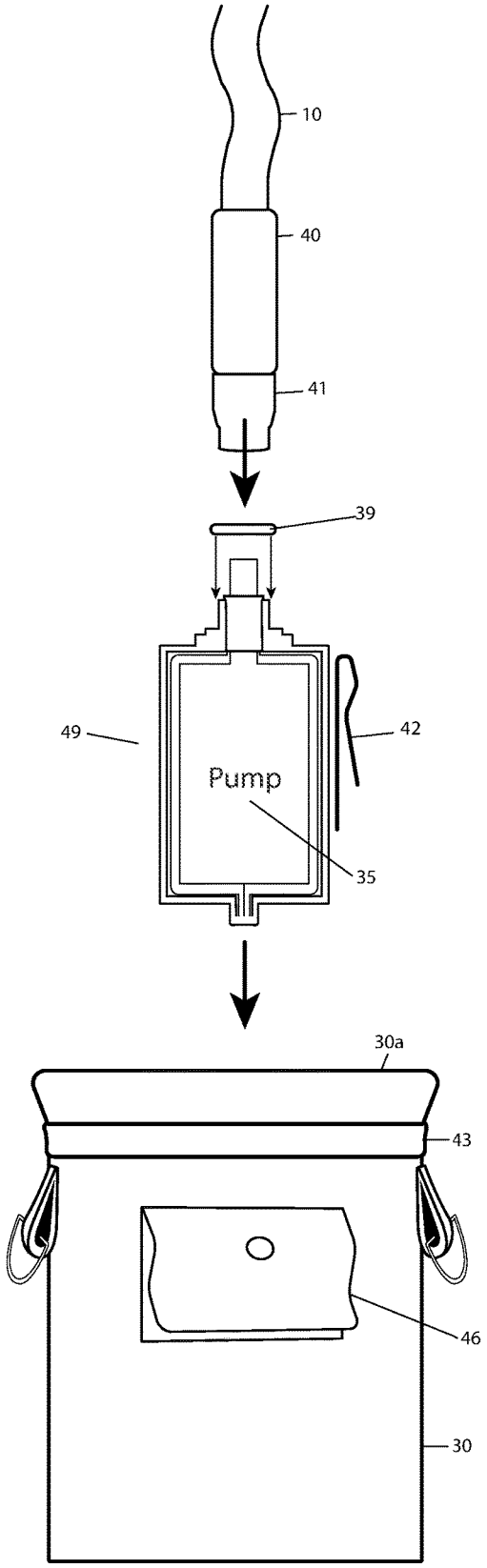
FIG. 16*b* is a cross-sectional view of the portable pump housing in a shut position and an illustration of how the air hose is attached to the portable pump and how the portable pump housing is inserted into a HEPA filter bag.

As shown in FIGS. 13*a*, 16*a*, and 16*b*, the portable air pump 35 may be housed in a HEPA filter bag 30. The HEPA filter bag 30 may advantageously serve the dual purposes of a pouch for carrying the portable air pump 35 and other personal items, as well as a filter for the air that the portable air pump 35 forces into the hose 10. The HEPA filter bag 30 shown in FIGS. 13*a*, 16*a*, and 16*b* has a relatively large filter surface area that allows for the use of a low power air pump 35. Also, the low power air pump 35 and HEPA filter bag 30 of the present invention are small enough to be worn comfortably under protective garments, such as a PPE suit. The HEPA filter bag 35 may be made of any material understood by those skilled in the art to be effective to sufficiently capture and filter out particulates and airborne contaminants, including, but not limited to, plastic or fiberglass, for example. The HEPA filter bag 35 may be composed of any material configured to substantially filter out various pollutants. In some embodiments, the HEPA filter bag 35 may be composed of a carbon filter material, non-woven fabric or any known synthetic fabrics that are suitable for filtering out airborne pollutants and contaminants.

FIG. 1 shows a front perspective view of the present invention in use, with loosened strap members 4,7, 8. The manner in which the strap members 4,7, 8 are releasably secured to the face shield 2, as described herein, allows for the strap members 4,7, 8 to be loosened to allow for a less snug fit of the protective face shield 1 to the wearer's head and face. In this mode of operation, the protective face shield 1 promotes ease of eating and drinking while still maintaining a fresh air flow.

FIG. 3 shows a front perspective view of the present invention in use, with tightened second, third and fourth strap members 4, 7, 8, which illustrates how the protective face shield 1 is more tightly secured to the wearer's head and face when the strap members 4, 7, 8 are secured in a relatively tight position. As can also be seen in FIG. 3, when the fourth strap member 8 is in a tightened position, it causes the face shield 2 to curve or bend in a position that significantly narrows or closes the opening at the bottom of the face shield 2. In turn an exit air vent hole is effectively created at the bottom of the face shield 2 in the process of utilizing the fourth strap member 8. As shown in FIG. 4, this vent hole can be covered with an external filtering mask 9 or membrane utilizing the integrated external mask connection pins 9*c*, 9*d*, 9*e*, 9*f*. It should also be mentioned the first strap member 3 is optional and some preferred embodiments omit the first strap member 3 entirely.

The embodiment in FIG. 3 is also shown to include an optional feature that allows for eyeglasses to be worn on the exterior of the face shield 2 while the protective face shield 1 is in use. As shown in FIG. 3, two small squares of adhesive mounting tape 50, 51 may be mounted on opposite sides of the face shield 2 for securing eyeglasses to the exterior of the face shield 2 while the protective face shield system 1 is in use.

Other embodiments of the present invention may advantageously include a swatch of mounting tape mounted upon the face shield 2 interior in varying locations to hold microphones or other devices internally. Yet another embodiment of the present invention may also include optional leverage extension strips, similar to the second extension strip 6 shown in FIG. 1. These are to be used as an aid in levering the temporal seal inwards, with the assistance of the third strap member 7, allowing for lowered headband tightness requirements to achieve adequate fit and seal. This feature makes the face shield system 1 seal very well while not applying uncomfortable force to the foam frame 11. These leverage extension strips help eliminate the crushing effect of the forehead seal as described above.

Figure 10A:
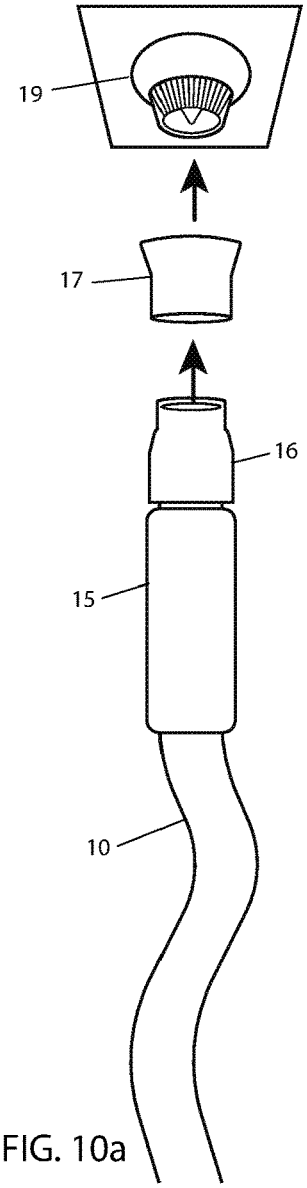
FIG. 10*a* is an illustration of an air hose of an embodiment of the invention and an adaptor that allows connection to an airplane air vent.
Figure 10B:
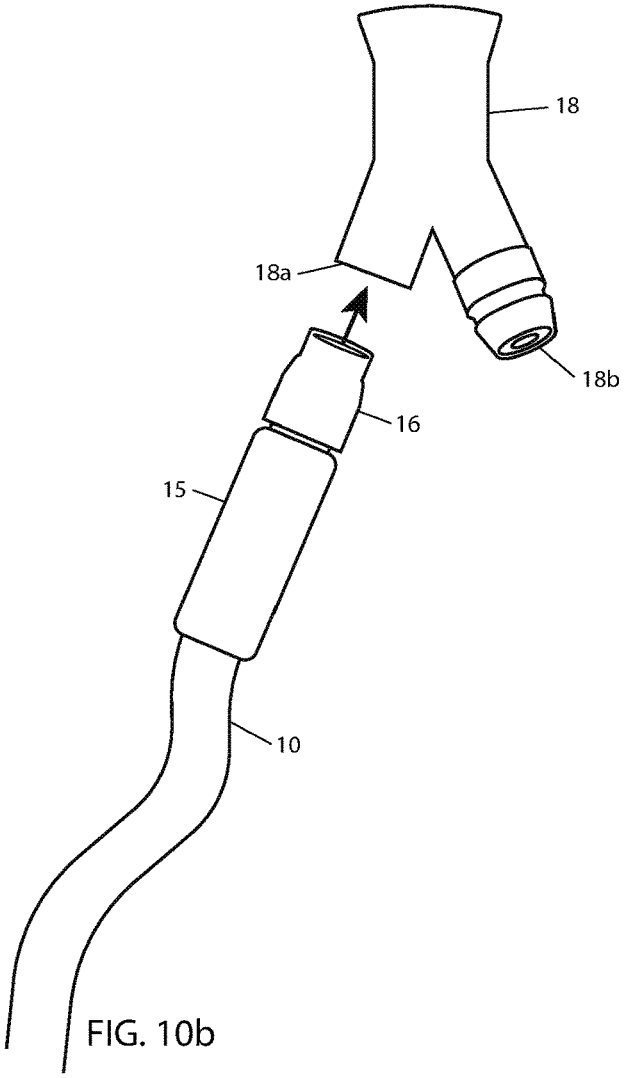
FIG. 10*b* is an illustration of an air hose and a two-way adaptor of an embodiment of the invention.
Figure 10C:
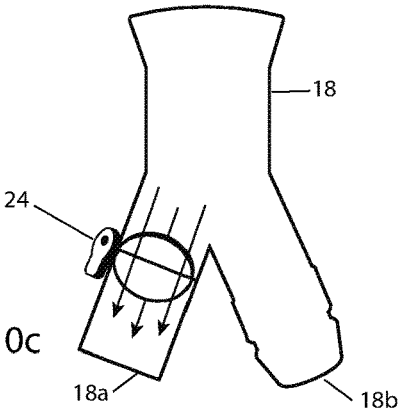
FIG. 10*c* is an illustration of an embodiment of the air hose adaptor of the invention with an open valve in the adaptor.
Figure 10D:
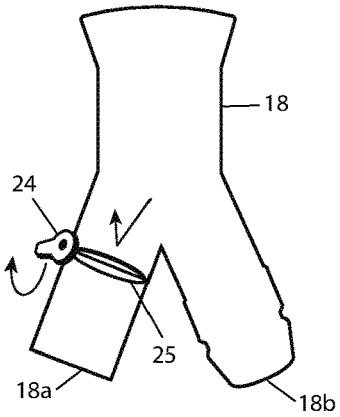
FIG. 10*d* is an illustration of an embodiment of the air hose adaptor of the invention with a closed valve in the adaptor.

In an alternative embodiment of the present invention, the second end of the hose 10 may be releasably affixed or connected to a standard air vent that is commonly found in airplanes, positioned directly above each passenger seat. As shown in FIG. 10*a*, the end of the hose 10 may be inserted into an adapter 17 that is sized to hold the end of the hose 10 in place. The adaptor likewise has an opposing opening that allows for the adaptor to attach to an airplane air vent 19, as shown in FIG. 10*a*. In yet another alternative embodiment, the present invention may also advantageously include a two-way air flow adapter 18 (see FIG. 10*b*) that has an opening 18*a* sized to secure the second end of the hose 10, thereby allowing air from the airplane vent 19 to flow into the hose 10. The two-way air flow adapter 18 also has an opposing opening sized and adapted to secure the two-way air flow adapter 18 to a standard airplane vent 19. The two-way air flow adapter 18 further has an outlet 18*b* that allows for air from the airplane air vent 19 to be directed towards the airplane passenger. As shown in FIGS. 10*c* and 10*d*, the two-way air flow adapter 18 may also include a valve 24 that allows for the air from the airplane vent 19 to be directed into the hose 10 when the valve 24 is in an open position as shown in FIG. 10*c*. When the valve 24, is in a closed position, as shown in FIG. 10*d*, the air from the airplane vent 19 is blocked from entering the hose 10 and is directed to the outlet 18*b* thereby directing all of the vented air in the direction of the airplane passenger.

The hose 10 may be connected to a standard airplane vent 19 by having an appropriately sized adapter 17 that is sized to allow for friction to secure the hose 10 and the airplane vent 19 to opposing ends of the adapter 17. Alternatively, a fitting 20 may be used to secure the hose 10 to an airplane vent 19. A fitting 20 may be placed over an airplane vent as shown in FIG. 11*c*. The fitting 20 has an adhesive surface 21 that secures the fitting 20 in place over an airplane vent 19. As shown in FIG. 11*b*, the fitting 20 has an opening for receiving the end of the hose 10. This opening of the fitting 20 may be sized to secure the end of the hose 10 by friction or, alternatively, any other means known in the art to secure the hose 10 to the fitting 20 may be used (i.e., a threaded fitting 20 opening that allows the end of the hose to be secured, much like a standard garden hose is attached to a standard hose bibb or faucet). As shown in FIG. 11*d*, when not in use, a small piece of plastic 23 may be used as a cover over the adhesive surface area of the fitting 20. FIGS. 11*a-e* also show a small release tab 22 that allows the user to easily disengage the fitting 20 from an airplane vent or any other air supply vent.

Figure 11A:
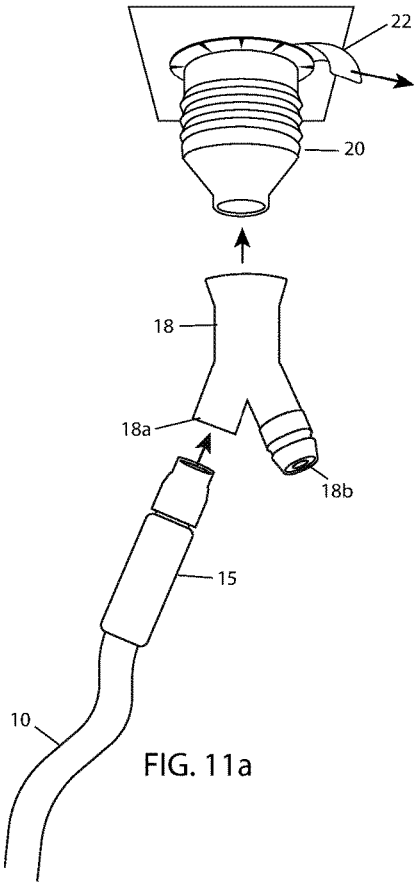
FIG. 11*a* is an illustration of an air hose and a two-way adaptor of an embodiment of the invention and a fitting that connects to an airplane vent.
Figure 11B:
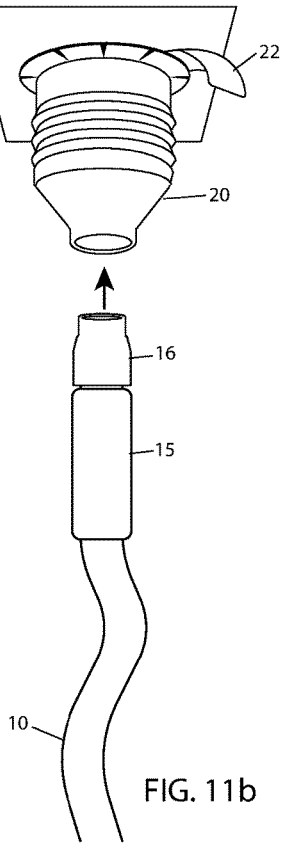
FIG. 11*b* is an illustration of an air hose of an embodiment of the invention and a fitting that operably connects the hose to an airplane vent.
Figure 11C:
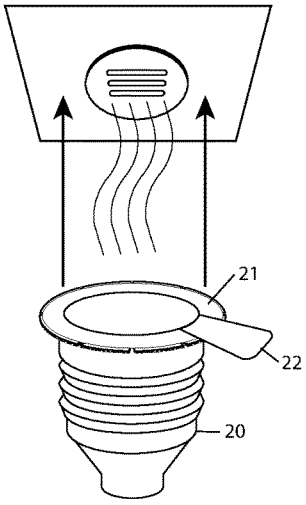
FIG. 11*c* is a perspective view of the detachable air vent fitting of an embodiment of the invention.
Figure 11D:
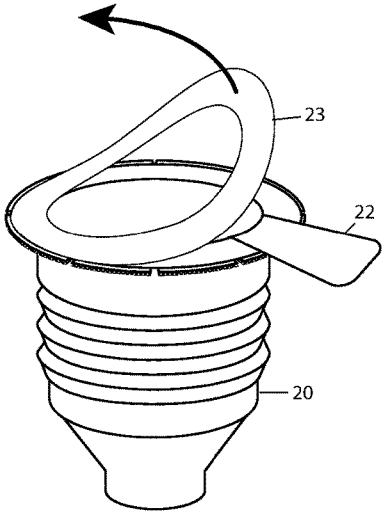
FIG. 11*d* is a perspective view of the detachable air vent fitting of an embodiment of the invention with an adhesive surface cover.
Figure 11E:
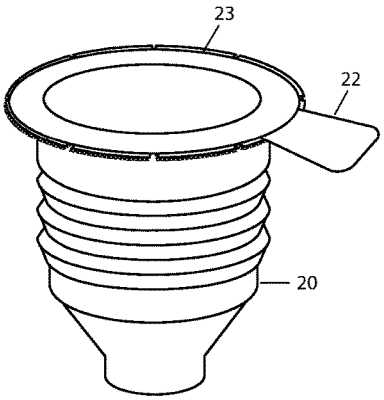
FIG. 11*e* is a perspective view of the detachable air vent fitting of an embodiment of the invention with an adhesive surface cover.

FIG. 11*a* shows an embodiment that allows for the two-way air adapter 18 to be attached to the hose 10 and the fitting 20, thereby allowing for the air from the airplane vent 19 to be directed to the hose 10 and through the outlet 18*b* towards the airplane passenger.

Although the embodiment described above enables air to be supplied from an airplane vent, it should be understood that the embodiment would likewise function in the same manner for virtually any other type of vent or air supply.

Figure 12:
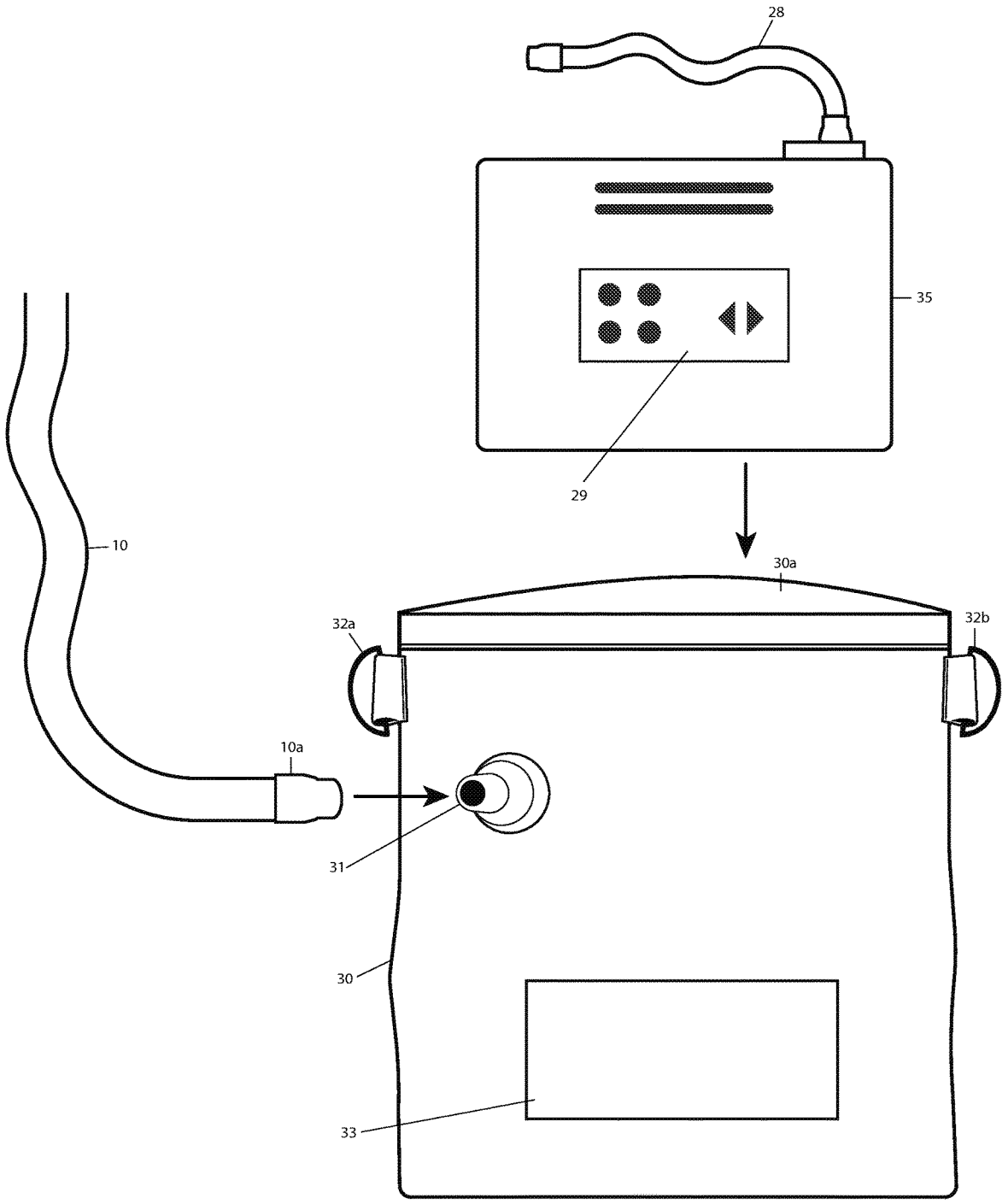
FIG. 12 is an illustration of a front view of a HEPA filter bag of an embodiment of the invention and a portable air pump that may be housed in the HEPA filter bag.
Figure 13B:
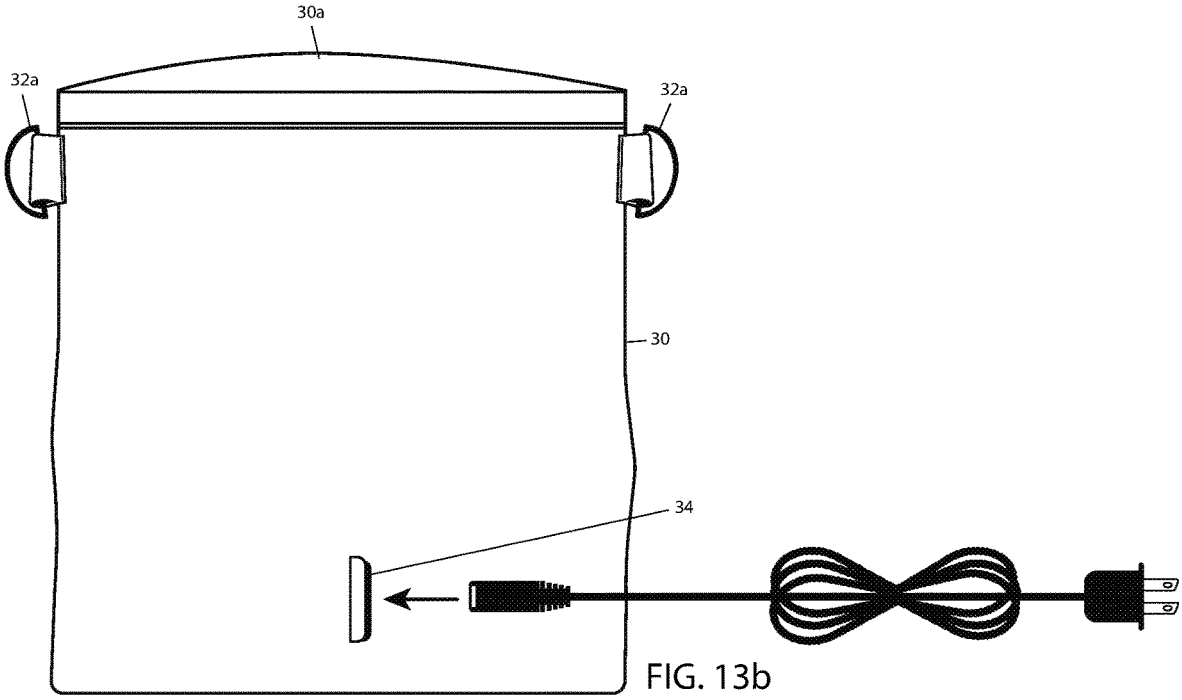
FIG. 13*b* is a rear view of the HEPA filter bag of an embodiment of the invention.

FIGS. 12 and 13*a* show how the hose 10 may be connected to a port 31 of the HEPA filter bag 30. From the inside of the HEPA cloth filter bag 30, the port 31 also is connected to a small hose 28 through which the portable air pump 35 housed within the HEPA filter bag 30 directs air. The portable pump generates clean filtered air that is directed through the small hose 28 and further through the hose 10. As shown in FIGS. 12 and 13*a*, in one preferred embodiment, the HEPA filter bag 30 has a transparent pane 33 that allows the user to manipulate control buttons on the control panel 29 of the portable air pump that is housed inside the HEPA filter bag 30. FIG. 13*b* shows a rear view of the HEPA filter bag 30. As can be seen in FIG. 13*b*, the HEPA cloth filter bag 30 may feature a small opening 34 that allows for a power cord to be connected to the portable air pump housed inside the HEPA cloth filter bag 30. This opening 34 may be closed by use of adhesive tape, a soft rubber self-sealing grommet or any other suitable airtight means to secure the opening 34 in a closed position to prevent the introduction of particulates and contaminants into the HEPA filter bag 30. The HEPA filter bag 30 is not required to have this opening 34 at all if the portable air pump does not require connection to an electrical power cord, i.e., if the portable pump is battery powered.

Figure 14A:
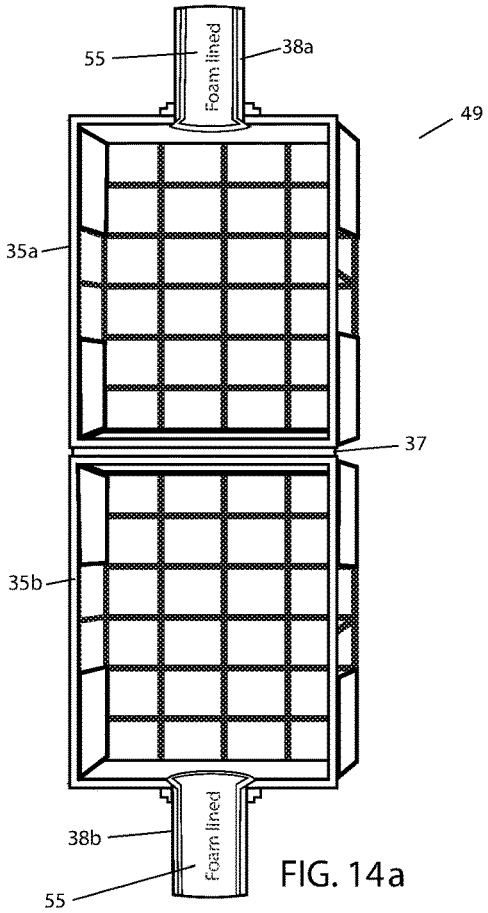
FIG. 14*a* is a front view of a portable pump housing of an embodiment of the invention.
Figure 14B:
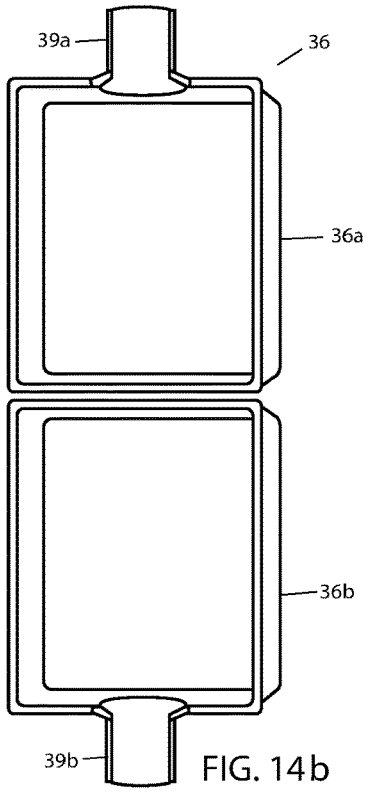
FIG. 14*b* is a front view of a pump casing of an embodiment of the invention.
Figure 14C:
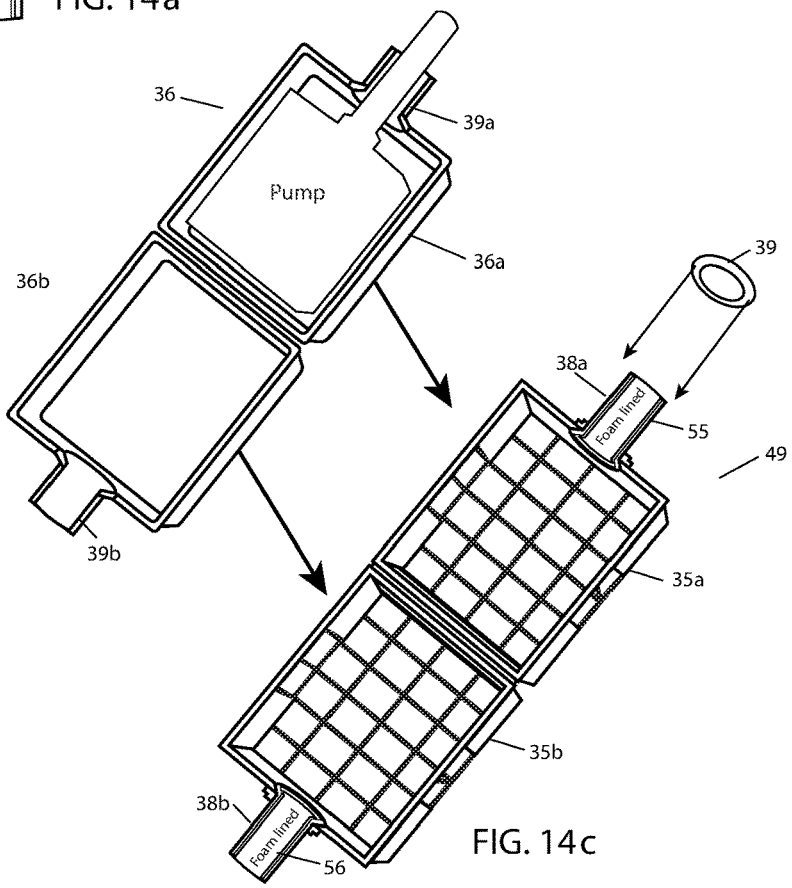
FIG. 14*c* is front view of the portable pump casing of an embodiment of the invention with an illustration of a portable pump housed therein and a portable pump housing.

In yet another embodiment of the present invention, during operation, the air pump 35 may be placed in an air pump HEPA filter material housing assembly. The components of the air pump housing assembly are shown in FIG. 14*c* and include a pump casing 36 comprised of two substantially rectangular-shaped nonwoven HEPA filter material filter halves 36*a*, 36*b* and a portable pump housing 49. FIG. 14*a* shows the portable pump housing 49 which has two substantially rectangular-shaped halves 35*a*, 35*b* that are connected by a small strip of flexible plastic that allows for the respective halves 35*a*, 35*b* to be folded with one on top of the other when the portable pump housing 49 is in a closed position, as shown in FIGS. 15*d* and 15*e*. The portable pump casing 36 has two nonwoven formed HEPA material filter halves 36*a*, 36*b* that are sized large enough to contain a portable air pump. The HEPA material filter halves 36*a*, 36*b* may be formed in part from a lightweight plastic frame that forms and retains the shape of each half 36*a*, 36*b*. Any other suitable material, other than lightweight plastic, may be used to form the HEPA material filter halves frames. The two portable pump housing halves 35*a*, 35*b* preferably are each constructed to form a cage-like structure, as shown in FIG. 14*a*, and are preferably constructed of a light-weight plastic or similar material. Although the portable pump housing halves 35*a*, 35*b* and the pump casing halves 36*a*, 36*b* shown in FIGS. 14*a-c* and FIGS. 15*a-c* are substantially in the shape or form of a rectangular box, they are not limited to that particular shape and can be formed in any shape and size that is suitable to accommodate housing of a portable pump.

Figure 15A:
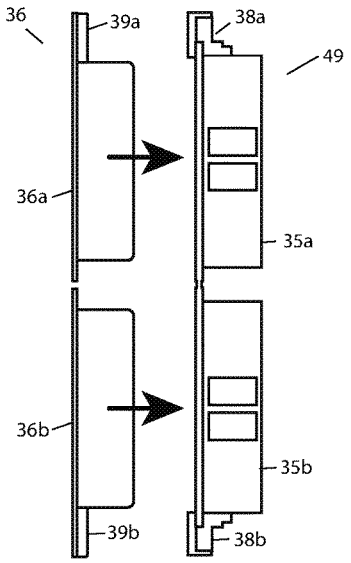
FIG. 15*a* is a side view of the portable pump casing and portable pump housing of an embodiment of the invention.
Figure 15B:
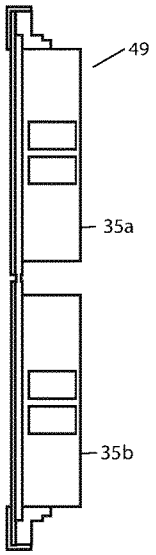
FIG. 15*b* is a side view of the portable pump casing housed within the portable pump housing.
Figure 15C:
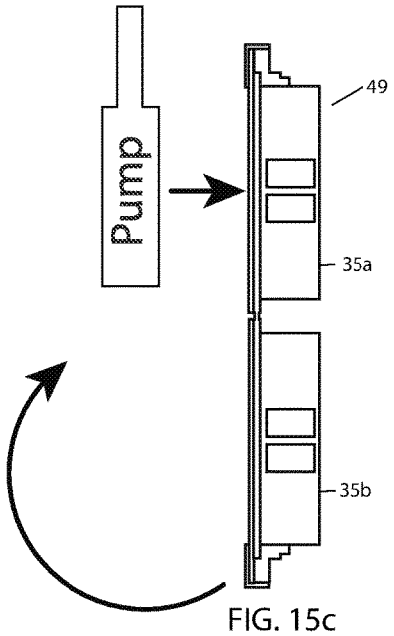
FIG. 15*c* is a side view of the portable pump casing housed within the portable pump housing and an illustration showing how a portable pump is inserted into the portable pump filter casing and an arrow showing the direction in which the portable pump housing can be closed.
Figure 15D:
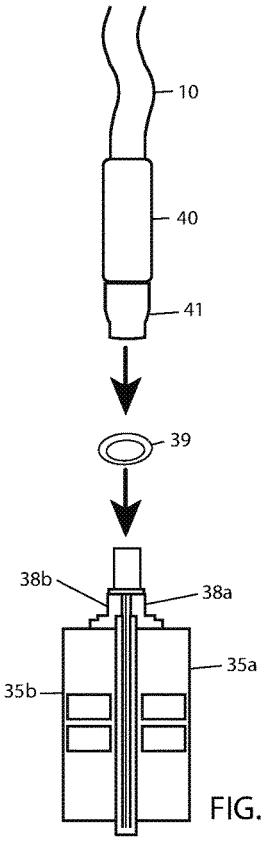
FIG. 15*d* is a side view of the portable pump housing in a shut position and an illustration of how the air hose is attached to the portable pump.
Figure 15E:
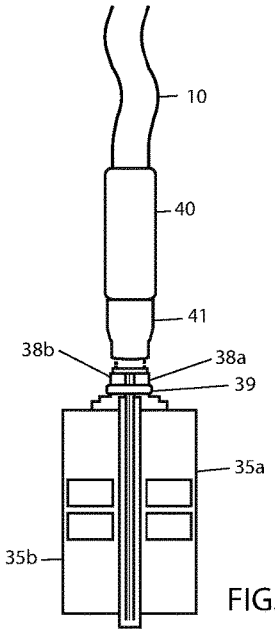
FIG. 15*e* is a side view of the portable pump housing in a shut position and an illustration of how the air hose is operably attached to the portable pump.

When in operation, a portable air pump 35 is placed inside either one of the substantially rectangular-shaped nonwoven HEPA material filter casing halves 36*a*, 36*b* and the HEPA material filter halves 36*a*, 36*b* are each placed inside one of the corresponding pump housing halves 35*a*, 35*b* of the portable pump housing 49 (see FIGS. 15*a* and 15*b*). FIG. 15*c* illustrates how once the portable air pump is placed inside the portable pump nonwoven HEPA filter material casing 36 and the HEPA filter casing halves 36*a*, 36*b* of the portable pump housing 36 are placed inside the portable pump casing 49, the portable pump casing 49 may then be closed in the same manner a suitcase is closed, by rotating either one of its halves 35*a*, 35*b* until it is in a position where it is directly facing its opposing half 35*a*, 35*b*. As shown in FIGS. 14*a* and 14*b*, the portable pump casing 49 has two outlet members 38*a*, 38*b* and the portable pump housing has two corresponding outlet members 39*a*, 39*b* that create an outlet when the portable pump casing 49 is in a closed position (see FIGS. 15*d* and 15*e*). Outlet members 35*a*, 35*b* are foam lined, helping to create an airtight, secure seal with the portable air pump 35 output hose when in the closed position. FIGS. 15*d* and 15*e* show how the outlet formed by the respective outlet members 38*a*, 38*b*, 39*a*, 39*b* and foam seal 55 allows for a small air hose operably connected to the portable air pump 35, to extend outside the air pump housing assembly 49 to be connected to the hose 10 that is, in turn, connected to the foam frame 11. As shown in FIGS. 15*d* and 15*e*, a standard O-ring 39 may be employed to tightly secure the portable pump casing 49 in a closed position. FIG. 17 shows an embodiment of the present invention where the portable air pump 35 is housed in the air pump housing assembly and the portable air pump 35 is operably attached to the hose 10 to provide filtered air to the user wearing the face shield 2 of the present invention. The closeable, multi-component air filtering and pump housing assembly 49 with replaceable filters allows for up to P100 filtration elements to be utilized.

FIG. 16*a* shows a HEPA filter bag 30 that may be used in an embodiment of the present invention, where a standard draw string 44, 45 assembly is used to close the bag 30. FIG.

16*b* shows an alternative version of a HEPA filter bag 30 that may be used in an embodiment of the present invention, having a metal or plastic belt or garment clip 46 to facilitate wearing of the HEPA cloth filter pouch container 30.

Having described the preferred embodiment of the present invention, any number of changes, variations and improvements which may be apparent to those skilled in the art are within the scope of the invention claimed and described herein.

What is claimed is:

1. A powered air-purifying respirator and protective face shield system, comprising:

a face shield assembly comprising:

a transparent face shield wearable over a wearer's face, a foam frame secured to an interior of the face shield and disposed between the face shield and the wearer's face to form a seal that prevents entry of airborne particulates and contaminants into an area between the wearer's face and the face shield;

a chin strap that, when in an attached position, causes curvature of the face shield to create a seal around and under the wearer's chin area to prevent airborne particulates and contaminants from entering or exiting the area between the wearer's face and the face shield;

a portable air pump housed in a nonwoven HEPA cloth filter bag and an air hose comprising a first end and a second end that is opposite the first end, wherein the first end is operably connected to the face shield assembly and the second end is operably connected to the portable air pump for providing clean filtered air from said portable pump to the area inside the face shield, wherein said foam frame has an inner canal that is adapted to receive filtered air pumped through said air hose and to direct filtered air into a plurality of vents that in turn direct filtered air from the inner canal into the area inside the face shield, and a coiled compression spring is positioned inside said inner canal of said foam frame to prevent said canal from closing and blocking air flow when the face shield is strapped tightly to the wearer's head, and the coiled compression spring is configured to receive the first end of the air hose, the coiled compression spring extends substantially an entire length of the foam frame.

2. A powered air-purifying respirator and protective face shield system according to claim 1, wherein said transparent face shield is secured to the wearer's head by one or more flexible, self-adhesive strap members.

3. A powered air-purifying respirator and protective face shield system according to claim 2, wherein the one or more self-adhesive strap members have a first end fixedly attached to the face shield and a second end releasably attached to the face shield.

4. A powered air-purifying respirator and protective face shield system according to claim 2, wherein the one or more self-adhesive strap member is attached to the face shield by riveting.

5. A powered air-purifying respirator and protective face shield system according to claim 2, wherein at least one leverage extension strip is attached to the face shield and guides and secures in place the one or more self-adhesive strap members.

6. A powered air-purifying respirator and protective face shield system according to claim 5, wherein said leverage extension strip is comprised of rigid polycarbonate plastic.

7. A powered air-purifying respirator and protective face shield system according to claim 5, wherein said leverage extension strip has two opposing semi-circular shaped guides that aid in keeping the self-adhesive strap member in place.

8. A powered air-purifying respirator and protective face shield system according to claim 1, wherein two pieces of adhesive mounting squares are mounted upon said face shield for securing eyeglasses to an exterior of said face shield.

9. A powered air-purifying respirator and protective face shield system according to claim 1, wherein said face shield is tinted.

10. A powered air-purifying respirator and protective face shield system according to claim 1, wherein said face shield is comprised of polycarbonate film.

11. A powered air-purifying respirator and protective face shield system according to claim 1, wherein said face shield is comprised of polyester film.

12. A powered air-purifying respirator and protective face shield system according to claim 1, wherein at least two pins are attached to the face shield assembly to hold in place straps of a protective face mask worn by the wearer at least partially on the exterior of the face shield.

13. A powered air-purifying respirator and protective face shield system according to claim 12, wherein the at least two pins are attached to the face shield assembly by inserting one end of each said pin into the foam frame.

14. A powered air-purifying respirator and protective face shield system according to claim 1, wherein said nonwoven HEPA cloth filter bag has a transparent pane that allows controls of said portable pump to be visible.

15. A powered air-purifying respirator and protective face shield system according to claim 1, wherein said nonwoven HEPA cloth filter bag has a sealable opening that accommodates an insertion of a power cord into the nonwoven HEPA cloth filter bag.

16. A powered air-purifying respirator and protective face shield system according to claim 1, wherein said portable pump is encased in a nonwoven HEPA material filter casing that is housed within a portable pump housing and said portable pump housing is housed within the nonwoven HEPA cloth filter bag.

17. A powered air-purifying respirator and protective face shield system according to claim 1, wherein said foam frame has two opposing tapered ends adapted to allow the face shield to form a seal around the wearer's face when the chin strap is in an attached position.

18. An air-purifying respirator and protective face shield system, comprising:

a face shield assembly comprising:

a transparent face shield wearable over a wearer's face and a foam frame secured to the interior of the face shield and disposed between the face shield and the wearer's face to form a seal that prevents entry of airborne particulates and contaminants into an area between the wearer's face and the face shield, the foam frame comprises a first tubular foam piece, a second tubular foam piece and a third tubular foam piece, when the face shield assembly is being oriented in a tall vertical orientation, the third tubular foam piece extends horizontally between the first tubular foam piece and the second tubular foam piece, the third tubular foam piece is configured to contact the forehead of the wearer's face, the first tubular foam piece is configured to contact a first cheek of the wearer's cheeks and the second tubular foam piece is configured to contact a second cheek of the wearer's cheeks;

a chin strap that, when in an attached position, causes curvature of the face shield to create a seal around and under the wearer's chin area to prevent airborne particulates and contaminants from entering or exiting the area between the wearer's face and the face shield; and an air hose comprises a first end and a second end that is opposite to the first end, wherein the first end is operably connected to the face shield assembly and the second end is adapted to be operably connected to a clean air supply, wherein the air hose is inserted through an opening in the first tubular foam piece and into a channel formed in the third tubular foam piece, the transparent face shield comprises a first pin located on a first half portion of an upper peripheral edge and a second pin located on a second half portion of the upper peripheral edge, a third pin located on a bottom half portion of a first peripheral side edge of the transparent face shield, and a fourth pin located on a bottom half portion of a second peripheral side edge of the transparent face shield, wherein the first, second, third and fourth pins are configured to secure straps of a face mask to the transparent face shield.

19. An air-purifying respirator and protective face shield system according to claim 18, wherein said air supply is an airplane air vent.

20. An air-purifying respirator and protective face shield system according to claim 18, wherein said air hose includes an adapter sized to secure the air hose to the air supply.

21. An air-purifying respirator and protective face shield system according to claim 20, wherein said adapter has a first outlet that directs air from the air supply through the hose and a second outlet that directs air from the air supply downward in a direction of the passenger seated below the air supply.

22. An air-purifying respirator and protective face shield system according to claim 21, wherein said first outlet includes a valve that when in a closed position blocks air from the air supply from entering the hose and when in an open position allows air from the air supply to enter the hose.

23. An air-purifying respirator and protective face shield system according to claim 20, further comprising a fitting that operably connects the hose to the clean air supply.

24. An air-purifying respirator and protective face shield system according to claim 23, wherein said fitting has a first end with an adhesive surface that releasably attaches the fitting to the clean air supply and a second end that is releasably secured to the hose.

* * * * *